US006769371B2

(12) United States Patent
Sakakibara et al.

(10) Patent No.: US 6,769,371 B2
(45) Date of Patent: Aug. 3, 2004

(54) SEWING APPARATUS WITH NEEDLE BAR POSITION CHANGING CONTROL

(75) Inventors: Kaoru Sakakibara, Nagoya (JP); Akira Kaiya, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/633,685

(22) Filed: Aug. 5, 2003

(65) Prior Publication Data

US 2004/0025768 A1 Feb. 12, 2004

(30) Foreign Application Priority Data

Aug. 6, 2002 (JP) ..... 2002-228444

(51) Int. Cl.[7] ..... D05B 19/14

(52) U.S. Cl. ..... 112/470.01; 112/275

(58) Field of Search ..... 112/470.01, 275, 112/270, 302, 225

(56) References Cited

U.S. PATENT DOCUMENTS 6,641,598 B2 * 11/2003 Shimizu et al. ..... 112/302
6,694,904 B2 * 2/2004 Mamiya ..... 112/302

FOREIGN PATENT DOCUMENTS

JP 2002-91558 3/2002

* cited by examiner

*Primary Examiner*—Peter Nerbun
(74) *Attorney, Agent, or Firm*—Oliff & Berridge, PLC

(57) ABSTRACT

A sewing apparatus such as a household sewing machine includes a needle bar, a needle bar vertically moving mechanism, a needle bar position changing operation unit operated via the needle bar vertically moving mechanism to change a vertical position of the needle bar, a thread cassette having a thread accommodating section accommodating a supply of thread, a cassette mount to which the thread cassette is detachably attached, a cassette detector detecting the thread cassette attached to the cassette mount, and a needle bar position changing control unit controlling the needle bar vertically moving mechanism so that in a case where the needle bar position changing unit has been operated, the needle bar is changed from an upper stop position to a lower stop position or vice versa according to a position of the needle bar at the time of operation of the needle bar position changing unit when the thread cassette is attached to the cassette mount according to a result of detection by the cassette detector, the needle bar position changing control unit further controlling the needle bar vertically moving mechanism so that the needle bar is changed to the upper stop position irrespective of the position of the needle bar at the time of operation of the needle bar position changing unit when the thread cassette is unattached to the cassette mount according to the result of detection by the cassette detector.

7 Claims, 21 Drawing Sheets

| | | SPINDLE ANGLE IN OPERATIONOF NEEDLE UP-DOWN KEY | | | |
|---|---|---|---|---|---|
| | | UPPER STOP POSITION | UPPER STOP POSITION ~ LOWER STOP POSITION | LOWER STOP POSITION | LOWER STOP POSITION ~ UPPER STOP POSITION |
| THREAD CASSETTE IN OPERATION OF NEEDLE UP-DOWN KEY | ATTACHED | LOWER STOP POSITION | LOWER STOP POSITION | UPPER STOP POSITION | UPPER STOP POSITION |
| | UNATTACHED | (LOWER STOP POSITION) ↓ UPPER STOP POSITION | (LOWER STOP POSITION) ↓ UPPER STOP POSITION | UPPER STOP POSITION | UPPER STOP POSITION |

FIG.19

SEWING APPARATUS WITH NEEDLE BAR POSITION CHANGING CONTROL

BACKGROUND OF THE INVENTION

1. Field of the Invention

This invention relates to a sewing apparatus with a cassette mount to which a thread cassette is detachably attached, and more particularly to a technique for performing different needle bar position changing control manners depending upon whether or not the thread cassette has been attached to the cassette mount when a needle bar position changing means has been operated.

2. Description of the Related Art

There has conventionally been proposed a sewing apparatus which includes a cassette mount to which a thread cassette accommodating a thread spool is detachably attached and in which a thread drawn from the thread cassette serves as a needle thread. In the sewing apparatus, the thread drawn from the thread cassette attached to the cassette mount is caught between a pair of thread tension discs of a thread tensioning mechanism. The thread extending downstream from the thread tension discs is caught on a needle thread take-up lever, and the thread extending downstream from the lever is passed through an eye of a sewing needle mounted on a needle bar.

It is desirable that the above-described sewing apparatus be provided with a threading mechanism for passing a thread drawn from the thread cassette attached to the cassette mount through an eye of a sewing needle. Furthermore, in order that the thread may be passed through the needle eye, the threading mechanism needs to be operated while a needle bar vertically moved by a needle bar vertically moving mechanism is stopped at an upper stop position.

On the other hand, the assignee of this application filed a Japanese patent application assigned with Application No. 2002-91558 and relating to a sewing apparatus including a thread carrying mechanism and a threading mechanism each operated in synchronization with attachment of the thread cassette to the cassette mount. The thread drawn from the thread cassette is automatically passed through the needle eye by the thread carrying mechanism and threading mechanism. In the disclosed sewing apparatus, the thread drawn from the thread cassette is caught and carried near the needle eye by the thread carrying mechanism, and the carried thread is caught by the threading mechanism to be passed through the needle eye.

In the above-described sewing apparatus, the threading mechanism is operated in synchronization with the operation of attaching the thread cassette to the cassette mount. Accordingly, in order that passing the thread through the needle eye may be realized by the threading mechanism, the thread cassette needs to be attached to the cassette mount while the needle bar is stopped at an upper stop position.

Cloth to be sewn is set to the sewing apparatus while the needle bar is stopped at the upper stop position. While the needle bar is stopped at a lower stop position, the thread is stuck into the set cloth so that a positional relationship is maintained between the cloth and needle. The cloth can be turned about the needle in order that a sewing direction may be changed. In conventional sewing apparatus, a needle up-down key is provided which is operated to change the position of the needle bar between the upper and lower stop positions alternately. Furthermore, there are some conventional sewing machines in which the threading mechanism is not operated when the needle bar has a height lower than a predetermined one.

When a conventional sewing machine with the cassette mount to which the thread cassette is detachably attached includes a threading mechanism, a user has a difficulty in moving the needle bar to the upper stop position to stop it there by operating a spindle pulley or the like while viewing the needle bar. Threading sometimes fails when the threading mechanism is operated although the needle bar is stopped at any position other than the upper stop position. The threading mechanism or the like would be damaged depending in certain conditions. A trial-and-error operation would be required at many times until the needle bar reaches a suitable height. As a result, the working efficiency would be reduced.

In the sewing apparatus disclosed in aforesaid Japanese patent application No. 2002-91558, the thread cassette needs to be attached to the cassette mount while the needle bar is stopped at the upper stop position. The above-described problems also apply to the disclosed sewing apparatus. When threading has failed, the thread cassette would need to be re-attached to the cassette mount, and the preparation for threading needs to be re-executed, thereby resulting in troubles.

Furthermore, the aforesaid needle up-down key may be applied to the sewing apparatus with the cassette mount to which the thread cassette is attached. However, the needle bar is changed between the upper and lower stop positions alternately every time the needle up-down key is operated. Accordingly, even when the needle up-down key is operated before threading so that the needle bar is located at the lower stop position, the threading mechanism would sometimes be operated (or the thread cassette would be attached to the cassette mount in the sewing apparatus disclosed in Japanese patent application No. 2002-91558).

The location of the needle bar needs to be confirmed in order that the user may operate the needle up-down key to stop the needle bar at the upper stop position. Furthermore, in certain cases, the needle up-down key needs to be operated twice to stop the needle bar at the upper stop position. Thus, load applied to the user is increased and accordingly, the position change is troublesome. In order that the sewing apparatus may be improved in the convenience thereof, it is desirable that the needle up-down key be operated to change the needle bar between the upper and lower stop positions alternately.

SUMMARY OF THE INVENTION

Therefore, an object of the present invention is to provide a sewing apparatus in which when a needle bar position changing means is operated, the needle bar is changed to the upper or lower stop position according to the position at the time of operation of the needle bar position changing means in the case where the thread cassette is attached to the cassette mount, and the needle bar is changed only to the upper stop position when the thread cassette is unattached to the cassette mount, whereupon the thread cassette can desirably be attached to the cassette mount.

The present invention provides a sewing apparatus comprising, a needle bar, a needle bar vertically moving mechanism vertically moving the needle bar, a needle bar position changing operation unit operated via the needle bar vertically moving mechanism to change a vertical position of the needle bar, a thread cassette having a thread accommodating section accommodating a supply of thread, a cassette mount to which the thread cassette is detachably attached, a cassette detector detecting the thread cassette attached to the cassette mount, and a needle bar position changing control unit. The needle bar position changing control unit controls the needle bar vertically moving mechanism so that in a case where the needle bar position changing unit has been operated, the needle bar is changed from an upper stop position to a lower stop position or from the lower stop position to the upper stop position according to a position of the needle bar at the time of operation of the needle bar position changing unit when the thread cassette is attached to the cassette mount according to a result of detection by the cassette detector. The needle bar position changing control unit further controls the needle bar vertically moving mechanism so that the needle bar is changed to the upper stop position irrespective of the position of the needle bar at the time of operation of the needle bar position changing unit when the thread cassette is unattached to the cassette mount according to the result of detection by the cassette detector.

When the presence or absence of the thread cassette attached to the cassette mount has been detected by the cassette detector and the needle bar position changing operation unit has been operated, the needle bar position changing control unit controls the needle bar vertically moving mechanism on the basis of the result of detection by the cassette detector. In the control, when the thread cassette is attached to the cassette mount, the needle bar is changed from the upper stop position to the lower stop position or from the lower stop position to the upper stop position according to the position of the needle bar at the time of operation of the needle bar position changing unit. When the thread cassette is unattached to the cassette mount, the needle bar is changed to the upper stop position irrespective of the position of the needle bar at the time of operation of the needle bar position changing unit.

A space for set and removal of cloth to and from the sewing apparatus is defined below the needle bar when the needle bar is at the upper stop position. When the needle bar is at the lower stop position, the needle is stuck into cloth set to the sewing apparatus so that a positional relationship is maintained between the cloth and needle. In a case where the thread cassette has been attached to the cassette mount, the needle bar is changed between the upper and lower stop positions alternately every time the user operates the needle bar position changing operation unit once. On the other hand, when the thread cassette has not been attached to the cassette mount, the needle bar need not be changed to the lower stop position. Accordingly, the needle bar is changed to the upper stop position irrespective of the position of the needle bar when the user operates the needle bar position changing operation unit once.

The needle bar position changing control unit preferably controls the needle bar vertically moving mechanism so that when the thread cassette is unattached to the cassette mount according to the result of detection by the cassette detector and the needle bar is at the upper stop position, the needle bar is changed to the lower stop position once and subsequently to the upper stop position.

The sewing apparatus preferably further comprises a threading mechanism passing the thread drawn from the thread cassette through an eye of a needle attached to the needle bar when the thread cassette is attached to the cassette mount. In this case, the upper stop position is determined so that the threading mechanism is operable to pass the thread drawn from the thread cassette through the needle eye.

BRIEF DESCRIPTION OF THE DRAWINGS

Other objects, features and advantages of the present invention will become clear upon reviewing the following description of embodiment, made with reference to the accompanying drawings, in which;

FIG. 19 shows positions of the needle bar changed according to the needle bar position and presence or absence of the thread cassette;

DETAILED DESCRIPTION OF THE INVENTION

Figure 1:
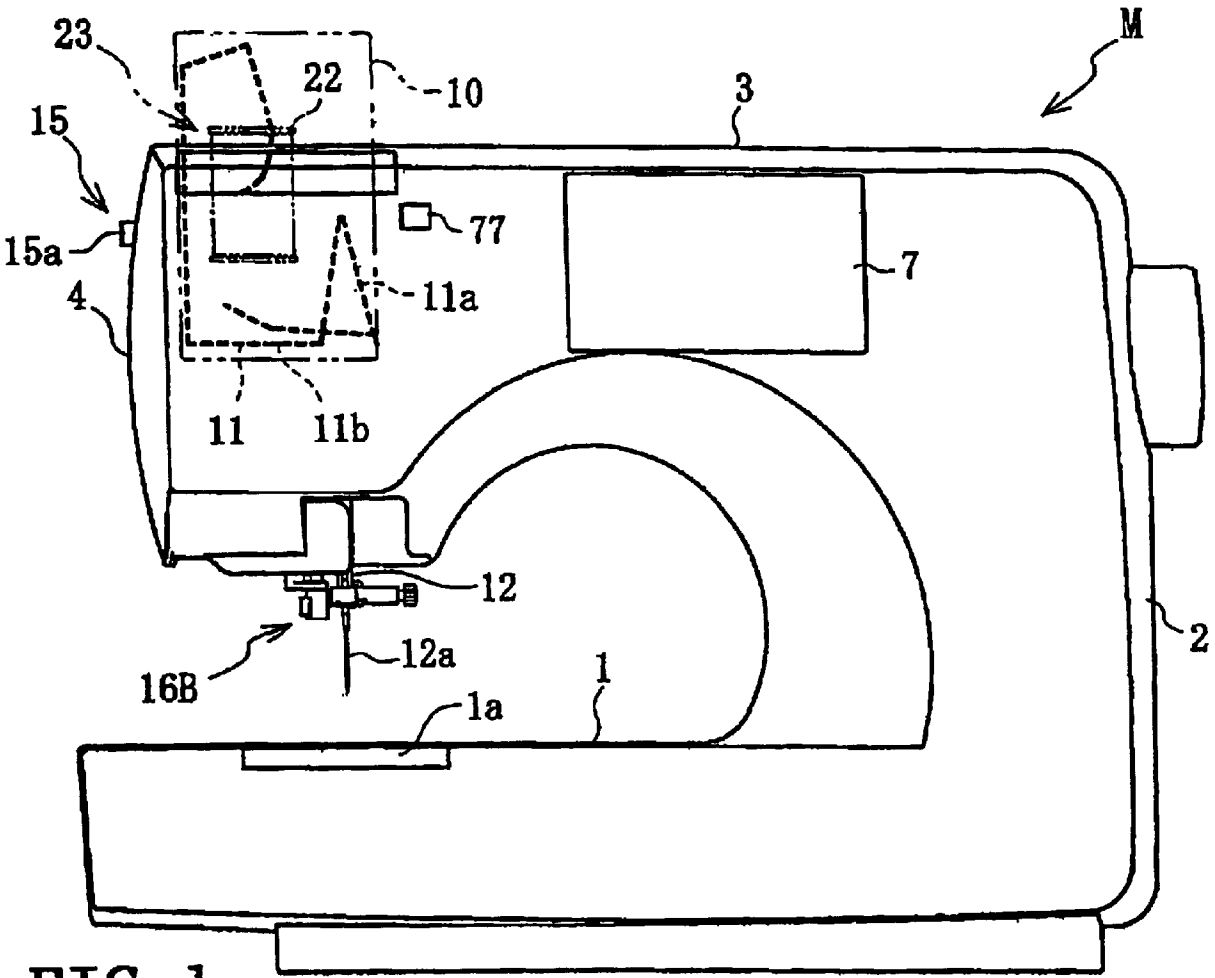
FIG. 1 is a front view of a sewing machine in accordance with one embodiment of the present invention during attachment of a thread cassette to a cassette mount.

One embodiment of the present invention will be described with reference to the accompanying drawings. The invention is applied to a household sewing machine provided with a cassette mount to which a thread cassette having a thread accommodating section for accommodating a supply of thread is detachably attached.

Referring to FIGS. 1 to 4, a household sewing machine M includes a sewing bed 1 having a horizontal bed plane, a pillar 2 standing from a right end of the bed 1, a sewing arm 3 extending left ward from an upper end of the pillar 2 so as to be opposed along the bed 1, and a machine head 4 located at a left end of the arm 3. The head 4 is provided with a cassette mount 5 to which a thread cassette 10 is detachably attached. A thread 11 drawn from the thread cassette 10 attached to the cassette mount 5 serves as a needle thread. The arm 3 or the head 4 thereof includes operation switches 6 (see FIG. 15) such as a sewing start switch, sewing finish switch, etc. The arm 3 further includes a liquid crystal display 7 and a touch panel 8 provided on the surface of the liquid crystal display.

Referring to FIGS. 2, 4, 9 and 10, in the head 4 are provided a needle bar 12, a needle thread take-up lever 13, a thread tensioning mechanism 14 adjusting a thread tension of the needle thread drawn from the thread cassette 10 attached to the cassette mount 5. In the head 4 are further provided a cassette detaching mechanism 15 including a detaching operation member 15*a* operated for detachment of the thread cassette 10 attached to the cassette mount 5. The head 4 further includes a thread carrying mechanism 16A, a threading mechanism 16B and a needle bar threading mechanism 17 all of which are operated in synchronization with attachment of the thread cassette 10 to the cassette mount 5. The head 4 still further includes a needle bar vertically moving mechanism 18 for vertically moving the needle bar 12, a needle bar rocking mechanism 19 for rocking the needle bar 12, and a needle thread take-up lever driving mechanism.

The thread carrying mechanism 16A catches the thread 11 drawn from the thread cassette 10 and carries the caught thread 11 near an eye 12*b* of a sewing needle 12*a*. The threading mechanism 16B passes the thread 11 carried by the thread carrying mechanism 16A through the needle eye 12*b*. The needle bar threading mechanism 17 causes the thread 11 to be caught on a thread guide H (see FIG. 12) of the needle bar 12.

Figure 3:
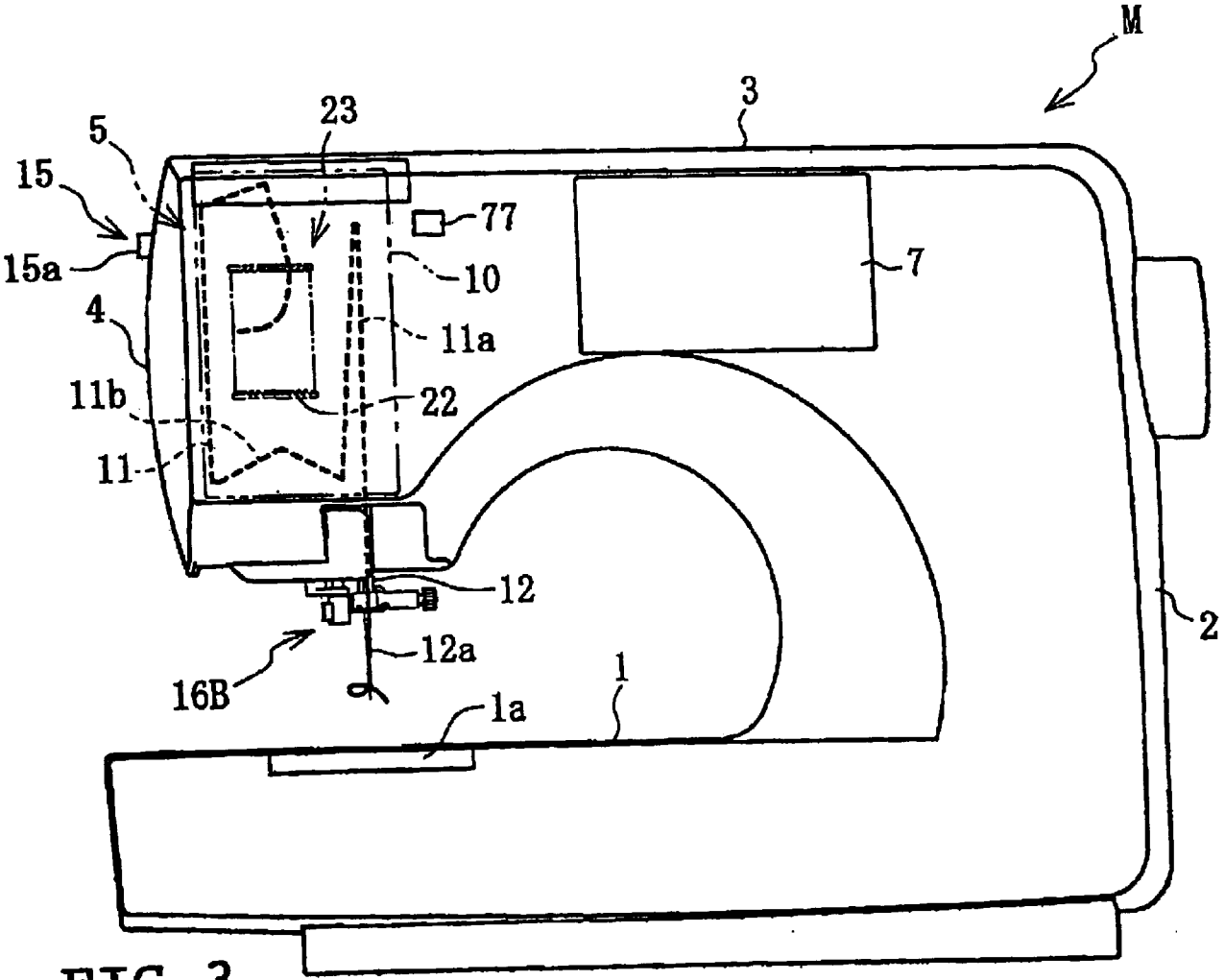
FIG. 3 is a front view of the sewing machine with the thread cassette having been attached.
Figure 4:
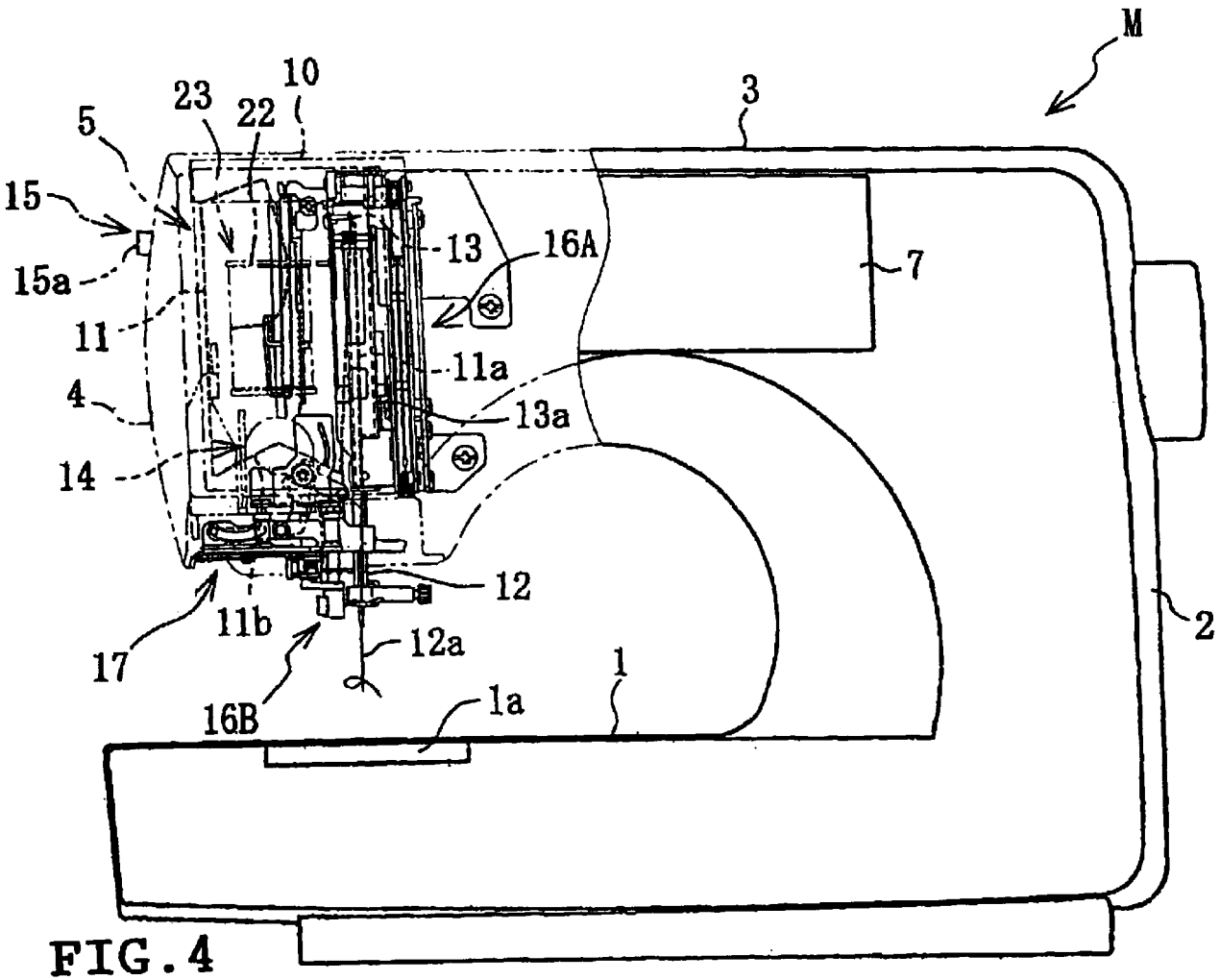
FIG. 4 is a front view of the sewing machine with the sewing head being eliminated.
Figure 5:
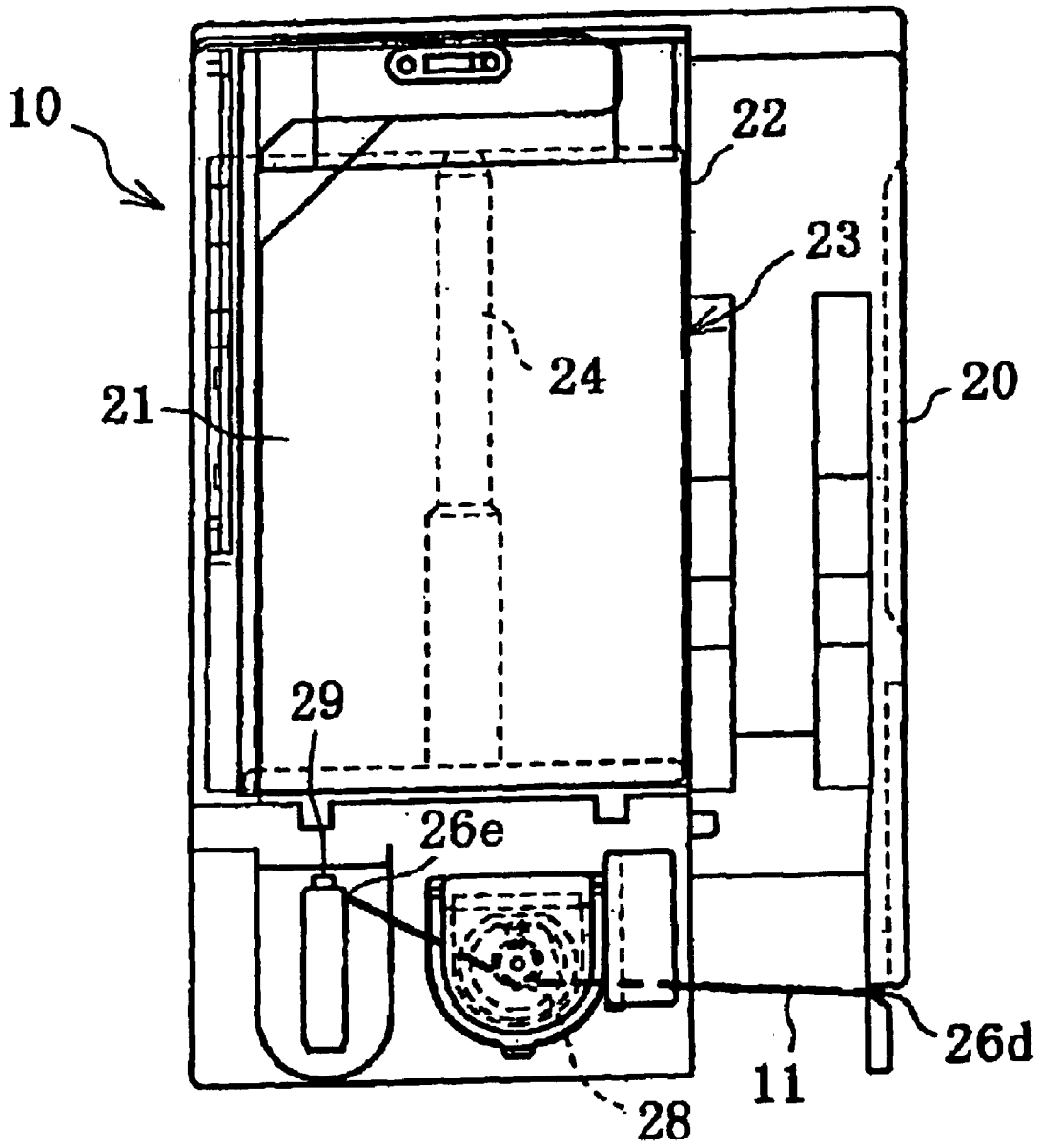
FIG. 5 is a front view of the thread cassette.
Figure 6:
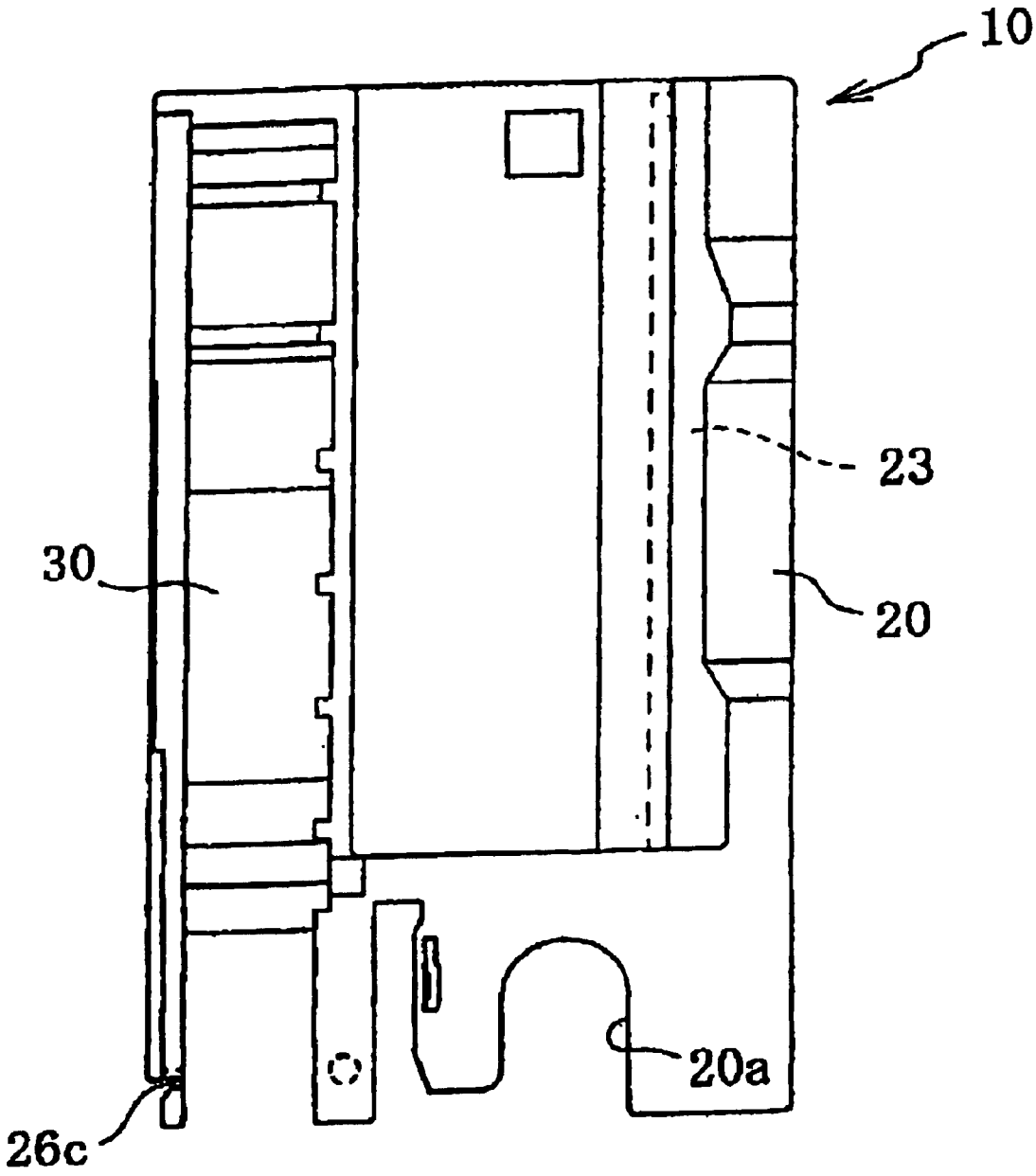
FIG. 6 is a rear view of the thread cassette.

Referring to FIGS. 3 and 4, the thread 11 drawn from the thread cassette 10 attached to the cassette mount 5 is placed on a thread tension shaft 40 (see FIG. 11) disposed between a pair of thread tension discs 41 and 42 of the thread tensioning mechanism 14 in attachment of the thread cassette 10 to the cassette mount 5. The thread 11 extending downstream from the thread tension shaft 40 is caught on the needle thread take-up lever 13. The thread 11 extending downstream from the needle thread take-up lever 13 is passed through the needle eye 12*b* (see FIG. 14), whereupon the thread 11 is set in the sewing machine M so that a sewing operation can be carried out.

The bed 1 is provided with a bobbin mount (not shown) to which a bobbin (not shown) is detachably attached. A thread drawn from the bobbin serves as a bobbin thread. The bed 1 is further provided with a shuttle mechanism (not shown). When the needle and bobbin threads are set for the sewing operation and a sewing machine motor 9 (see FIG. 15) is driven, the needle bar 12 is vertically moved by the needle bar vertically moving mechanism 18. The shuttle mechanism is driven in synchronization with the vertical movement of the needle bar 12 so that the needle thread 11 near the needle 12*a* lowered below a needle plate 1*a* of the bed 1, whereupon the needle and bobbin threads are entangled to be formed into stitches.

Figure 7:
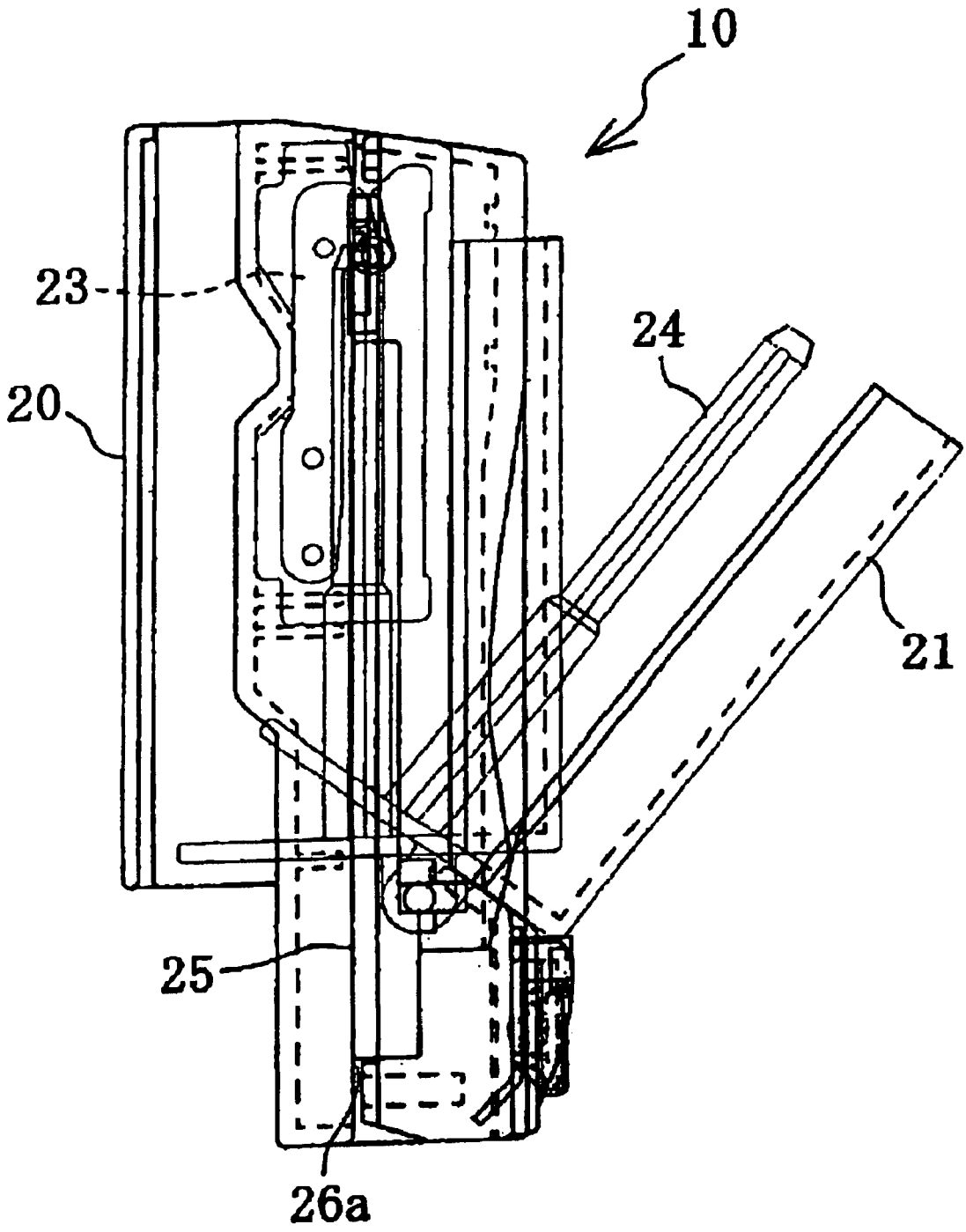
FIG. 7 is a left-hand side view of the thread cassette with the lid open.
Figure 8:
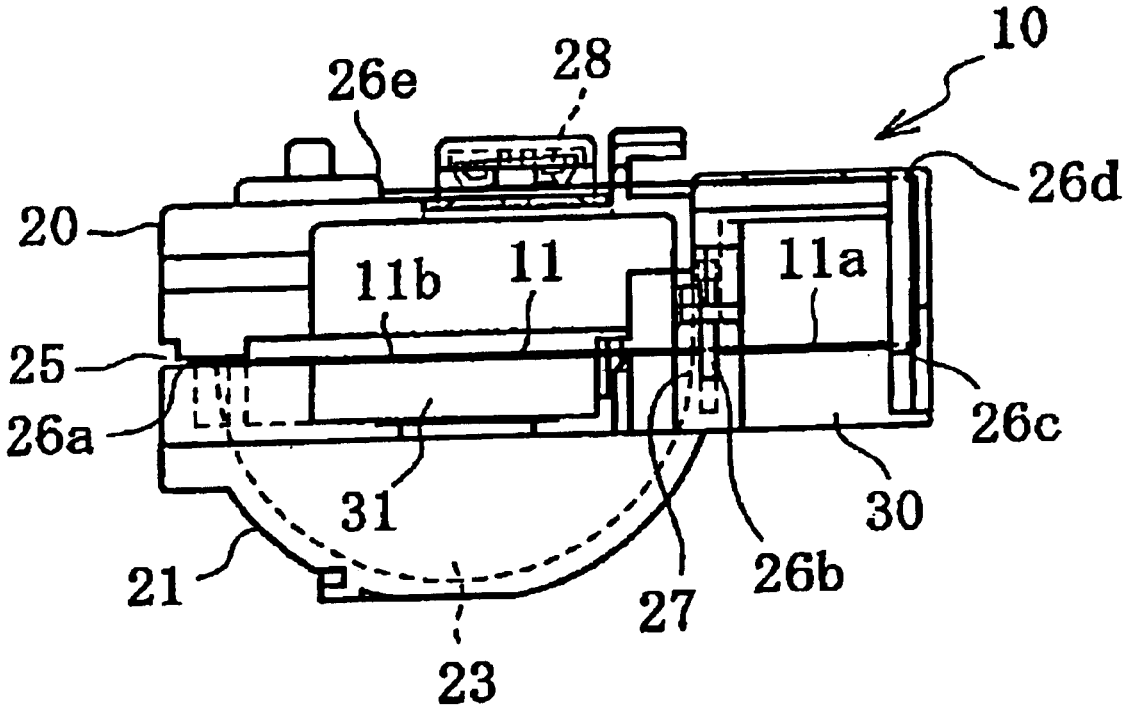
FIG. 8 is a bottom view of the thread cassette.

The thread cassette 10 will now be described. Referring to FIGS. 5 to 8, the thread cassette 10 comprises a cassette body 20 and a lid 21 pivotally mounted on the body 20. The cassette body 20 with the lid 21 defines therein a thread accommodating cavity 23 for accommodating a thread spool 22 serving as a supply of thread. A spool pin 24 is mounted on the lid 21. When the lid 21 is opened forward as shown in FIG. 7, the thread spool 22 is allowed to be attached to and detached from the spool pin 24. When the lid 21 is closed with the thread spool 22 attached to the spool pin 24, the thread spool is enclosed in the thread accommodating cavity 23.

The thread 11 extends upward from the thread spool 22 to be drawn out of the thread accommodating cavity 23. The thread 11 further extends through a thread path 35 defined between the cassette body 20 and a left-hand end of the lid 21. The thread 11 is then put on a first thread guard 26*a* at a left lower end of the thread cassette 10, further extending rightward thereafter to be put on a second thread guard 26*b* at a lower end of a partition wall 27 and a third thread guard 26*c* at a right lower end of the thread cassette 10. The thread 11 further extends forward to be put on a fourth thread guard 26*d* and is then returned to extend leftward. The thread 11 is then retained on a thread retainer 28. Furthermore, the thread 11 extending leftward is cut by a left blade 29 of the thread retainer 28 and the resultant end is put on a fifth thread guard 26*e* near the blade 29.

The thread cassette 10 is thus prepared for attachment to the cassette mount 5 as described above. A needle thread take-up lever guide space 30 defined at a right end of the thread cassette 10 extends substantially over the length of the cassette. The guide space 40 is open at the rear and the lower portion of the cassette. A thread tensioning space 31 is defined at a central lower end of the thread cassette 10 and open at a lower portion thereof. These spaces 30 and 31 are partitioned by a partition wall 27.

The thread cassette 10 is descended to be inserted into the cassette mount 5. In this case, the needle thread take-up lever 13 and a needle thread take-up lever guide 13*a* (see FIG. 2 etc.) guiding the lever enter the guide space 30 from below the cassette, whereas a thread tensioning shaft 40 (see FIG. 11) of the thread tensioning mechanism 14 and a pair of thread tension discs 41 and 42 enter the thread tensioning space 31 from below the cassette. A notch 20*a* is formed in the lower end of the rear wall of the cassette body 20 to prevent the thread tensioning shaft 40 from interference with the thread cassette 10. When the thread cassette 10 has been inserted slightly into the cassette mount 5, a thread part 11*a* between the thread guards 26*a* and 26*c* is caught by the needle thread take-up lever 13 in the guide space 30.

Figure 2:
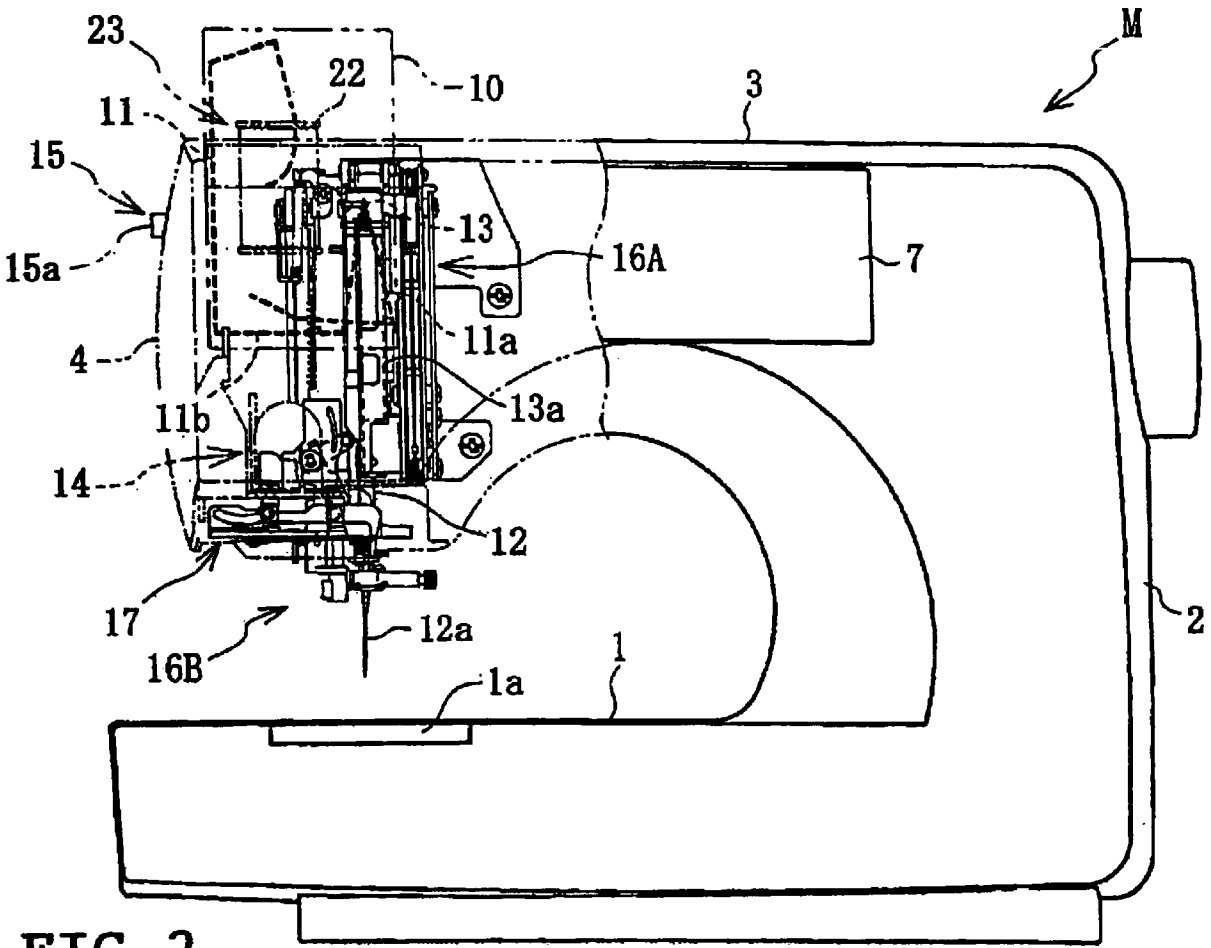
FIG. 2 is a front view of the sewing machine with the sewing head being eliminated.

Subsequently, when the thread cassette 10 is further inserted into the cassette mount 5, the thread guards 26*a* and 26*b* are descended relative to the needle thread take-up lever 13 on which a thread part 11*a* is caught. However, the thread downstream the thread part 11*a* is continuously held by the thread holding portion 28. Accordingly, the thread 11 is drawn from the thread spool 22 in the thread accommodating cavity 23. For example, the thread part 11*a* has a generally triangular shape when two thirds of the thread cassette are inserted into the cassette mount 5, as shown in FIGS. 1 and 2. When the thread cassette 10 is completely attached to the cassette mount 5, the thread part 11*b* between the thread guards 26*a* and 26*b* is caught on the thread tensioning shaft 40 between the paired thread tension discs 41 and 42 in the thread tensioning space 31.

Figure 11:
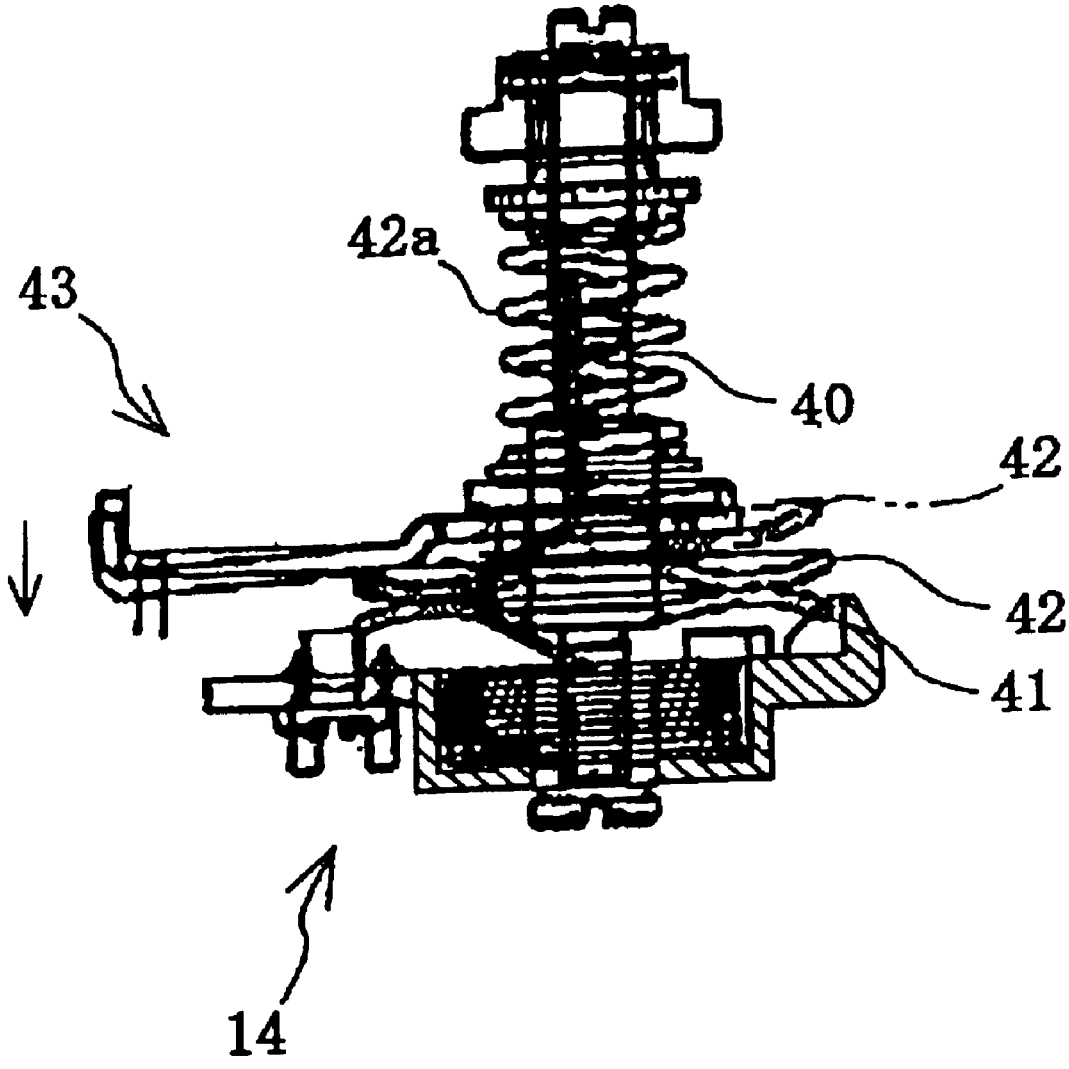
FIG. 11 is a plan view of thread tension discs of a thread tensioning mechanism.

The thread tensioning mechanism 14 will now be described. Referring to FIG. 11, the thread tensioning mechanism 14 includes the thread tensioning shaft 40 fixed to a frame (not shown) and extending rearward, the front thread tension disc 41 fixedly fitted with the shaft 40, the rear thread tension disc 42 fixedly fitted with the shaft 40 so as to be brought into a face-to-face contact with the front thread tension disc, and a thread tensioning spring 42*a* comprising a compression coil spring fitted with the shaft 40 so as to urge the rear disc 42 against the front disc 41. A drive mechanism 43 (see FIG. 10) is provided for opening and closing the thread tension discs 41 and 42 and includes a pulse motor 44 (see FIG. 15).

The drive mechanism 43 includes a plurality of gear members and link members as well as the pulse motor 44 and opens the thread tension discs 41 and 42 at least when the thread cassette 10 is attached to the cassette mount 5. The drive mechanism 43 opens the thread tension discs 41 and 42 when the thread cassette 10 is detached from the cassette mount 5. The pulse motor 44 also serves to drive the needle bar rocking mechanism 19.

Figure 9:
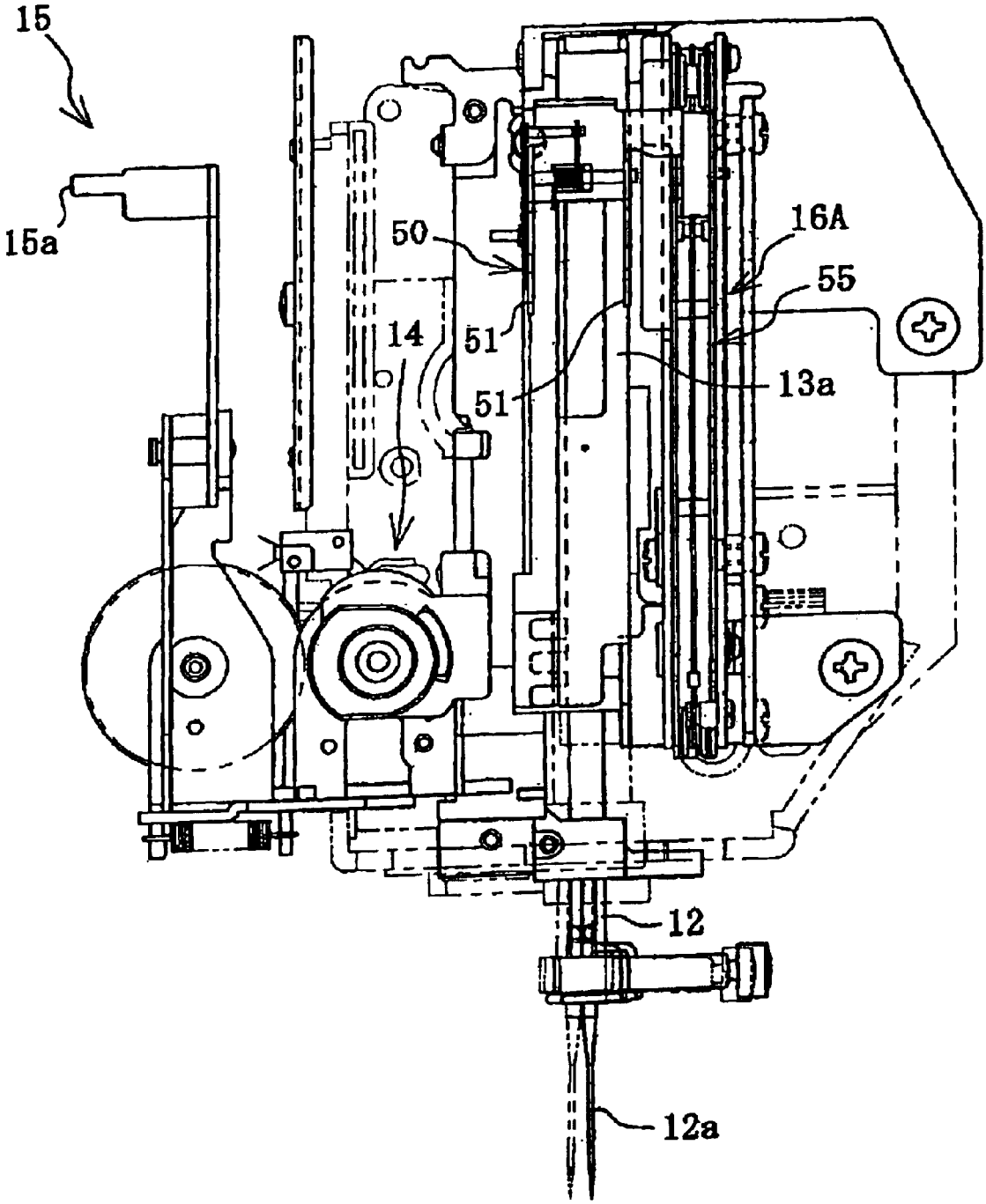
FIG. 9 is a front view of the front interior of the head.
Figure 10:
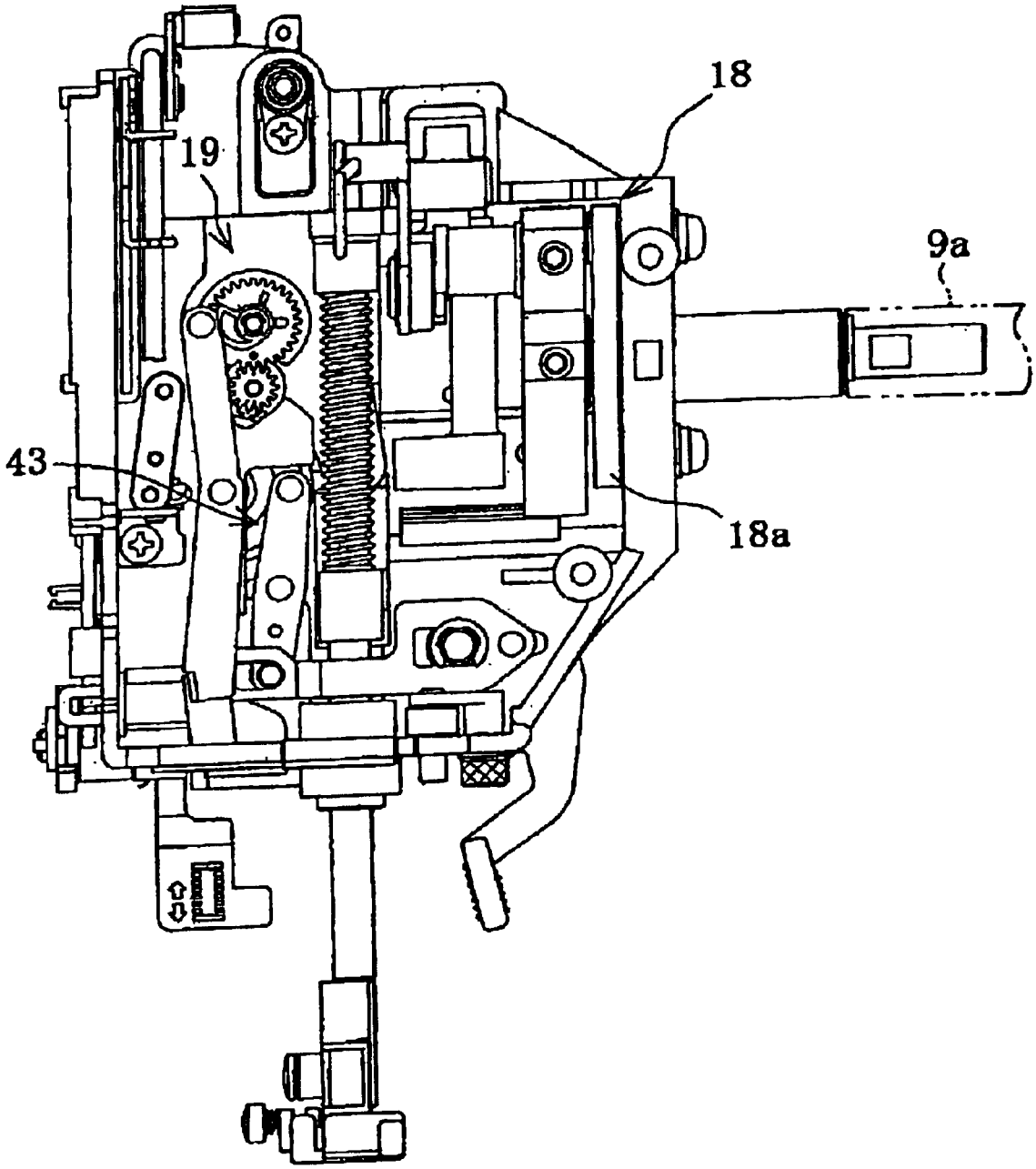
FIG. 10 is a front view of the front interior of the head in another condition.
Figure 12:
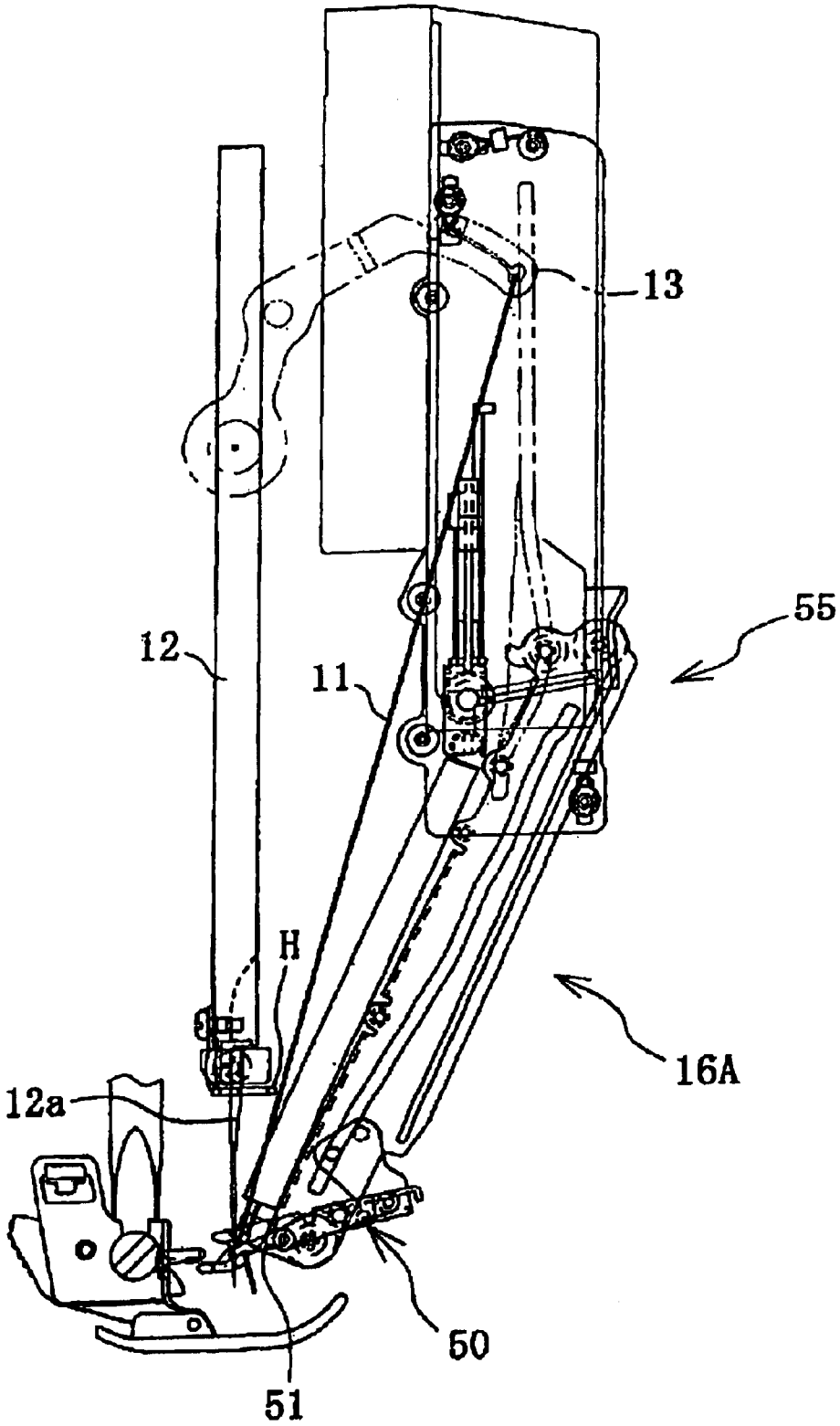
FIG. 12 is a left-hand side view of a thread carrying mechanism.

The thread carrying mechanism 16A will be described. Referring to FIGS. 9 and 12, the thread carrying mechanism 16A is provided on the frame on which a needle bar base 60 (see FIG. 13) is pivotally mounted and includes a threading member 50 catching the thread 11 drawn from the thread cassette 10 and a threading drive mechanism section 55 lowering the threading member 50 from a standby position (see FIG. 9) while the attitude of the threading member is being changed, whereby the threading member is transferred from a threading position (not shown) toward the thread carrying position (see FIG. 14).

The threading member 50 has a pair of threading plates 51. When the threading member 50 is at the threading position, a part of the thread 11 located downstream the needle thread take-up lever 13 is caught over the paired threading plates 51 in a tight state. Furthermore, when located at the thread carrying position, the threading member 50 is positioned relative to the position of the needle bar 12 with respect to the vertical position thereof, and the needle thread 12*a* is located between the threading plates 51, whereupon the thread 11 is close to the needle eye 12*b*.

Figure 13A:
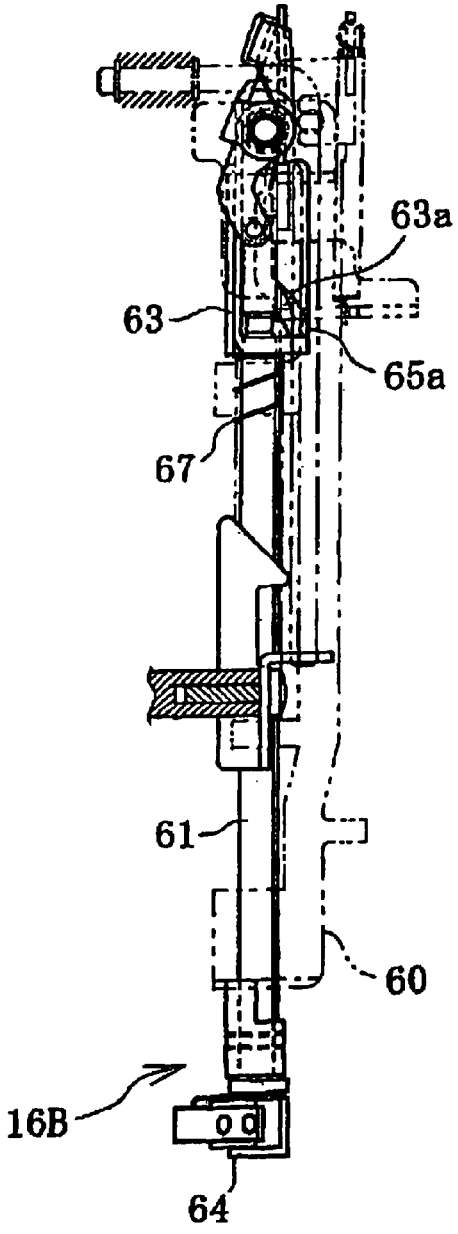
FIGS. 13A and 13B are a left-hand side view and a front view of a threading mechanism, respectively.
Figure 13B:
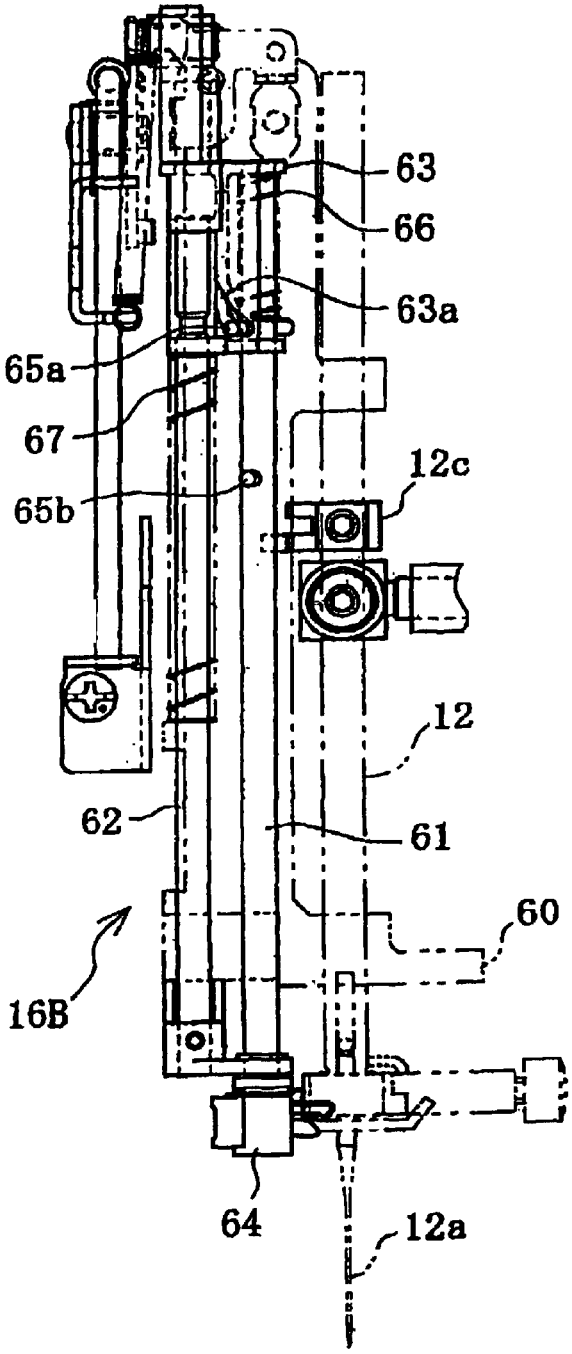

The threading mechanism 16B will be described. Referring to FIGS. 13 and 14, the threading mechanism 16B is mounted on the needle bar base 60 and includes a threading shaft 61 and slider guide shaft 62 supported on the needle bar base 60 on the left of the needle bar 12 so as to be vertically moved, a threading slider 63 fitted with upper portions of these shafts 61 and 62 so as to be vertically moved, and a hook mechanism section 64 mounted on a lower end of the threading shaft 61. The needle bar 12 is supported on the needle bar base 60 so as to be vertically moved. The needle bar base 60 has an upper end pivotally mounted on a frame. The needle bar 12 and the threading mechanism 16B are rocked together.

The threading shaft 61 has two pins 65*a* and 65*b* protruding from an upper portion thereof. The upper pin 65*a* is in engagement with a spiral engagement groove 63*a* formed in the threading slider 63, whereas the lower pin 65*b* is engageable, from above, with the engaging member 12*c* fitted with the needle bar 12. A compression coil spring 66 is provided around the threading shaft 61 to urge the slider 63 upward relative to the threading shaft, whereby the pin 65*a* usually engages a lower end of the engagement groove 63*a*. Furthermore, another compression coil spring 67 is provided around the slider guide shaft 62 to urge the threading slider 63 upward, whereby the threading shaft 61 and the threading slider 63 are usually located at respective upper limit positions. The hook mechanism section 64 includes a threading hook 68 capable of passing through the needle eye 12*b* and having a distal end formed with a threading portion 68*a*, two guide members 69 located at both sides of the threading hook 68 respectively, and a wire 69*a* engageable with the threading portion 68*a* of the threading hook 68.

The threading mechanism 16B is in the state as shown in FIG. 13 when the thread cassette 10 is unattached to the cassette mount 5. When the thread cassette 10 is inserted into the cassette mount 5, the threading slider 63 is descended. The threading shaft 61 is also descended with the threading slider 63 at an initial stage. The threading shaft 61 is disallowed to be moved downward thereby to be stopped when the pin 65*b* thereof engages the engagement member 12*c* of the needle bar 12 from above, whereupon the threading shaft is positioned in the vertical direction relative to the needle bar.

Figure 14A:
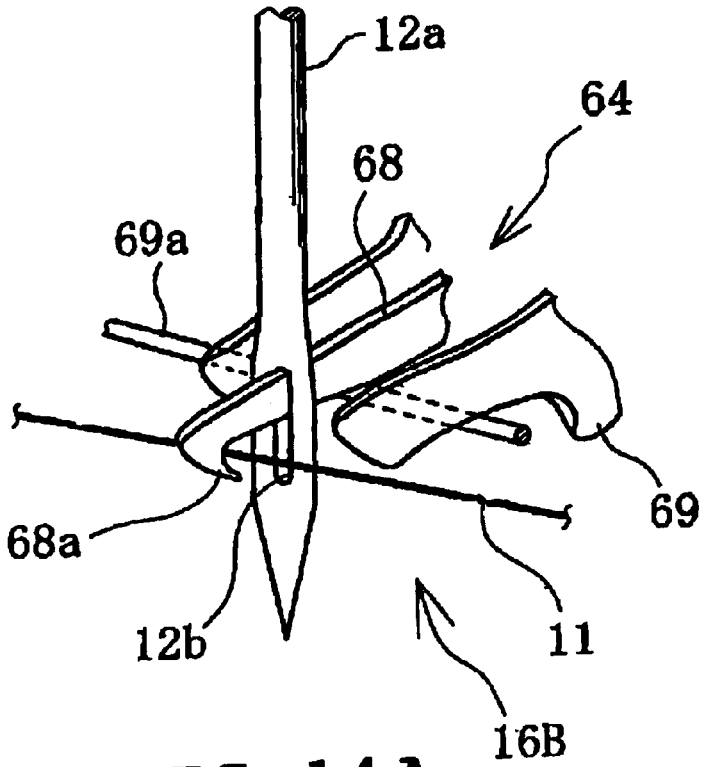
FIGS. 14A and 14B illustrate the threading mechanism when a threading hook extends through the needle eye and when the thread is passed through the needle eye with the threading hook having been returned through the needle eye, respectively.
Figure 14B:
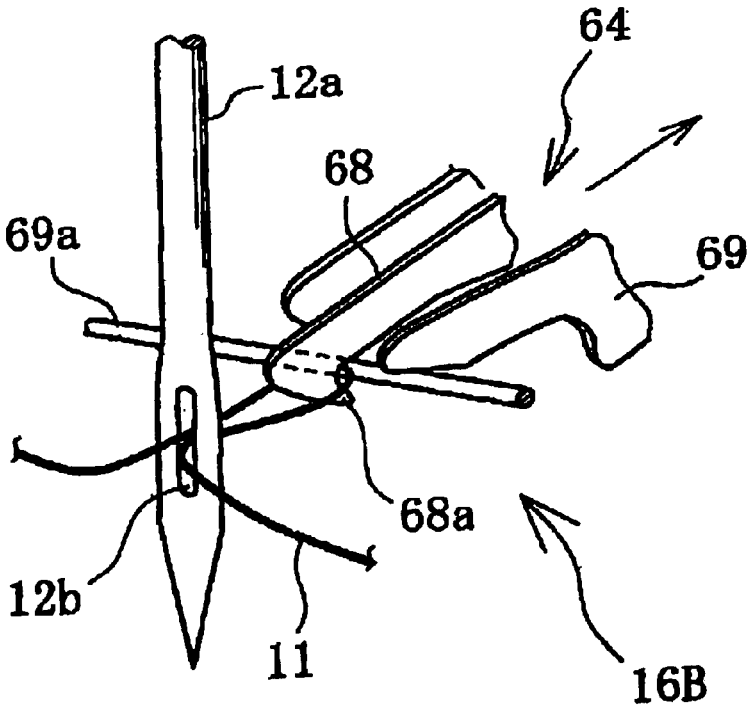

Subsequently, the threading slider 63 is descended relative to the threading shaft 61. Accordingly, the pin 65*a* engages the spiral engagement groove 63*a* of the threading slider 63 thereby to be moved upward, whereupon the threading shaft 61 is turned. At this time, the hook mechanism section 64 is located near the needle 12*a*, and moreover, the thread 11 drawn from the thread cassette 10 by the thread carrying mechanism 16A is carried near the needle 12*a*, held in front of the needle 12*a* in a stretched state. More specifically, when the threading shaft 61 is turned, the threading hook 68 of the hook mechanism 64 passes through the needle eye 12*b* as shown in FIG. 14A, so that the thread 11 is caught by the distal threading portion 68*a* of the threading hook 61 as shown in FIG. 14B. When the threading shaft 61 is then turned in the opposite direction, the threading hook 68 is returned through the needle eye 12*b* such that the thread 11 is passed through the needle eye 12*b*. At this time, the thread 11 is also placed on the needle bar thread guide H by the threading mechanism 17.

The sewing machine M is constructed so that the thread 11 can reliably be passed through the needle eye 12*b* when the thread carrying mechanism 16A and threading mechanism 16B are operated while the needle bar 12 is stopped at a predetermined upper stop position. More specifically, the needle bar 12 is stopped at the upper stop position with the thread cassette 10 detached from the cassette mount 5 in order that the thread 11 may reliably be passed through the needle eye 12*b*. In this state, the thread cassette 10 needs to be attached to the cassette mount 5 and the thread carrying mechanism 16A and threading mechanism 16B needs to be operated.

The needle bar vertically moving mechanism 18 transmits torque of the spindle 9*a* (see FIG. 10) rotated by the sewing machine motor 9 via a crank mechanism section 18*a* (see FIG. 10) etc., thereby vertically moving the needle bar 12. The needle bar 12 is reciprocated vertically during one turn of the spindle 9*a*.

Referring now to FIGS. 1 and 3, a needle up-down key or NP key 77 is provided on the front of the head 4. The needle up-down key 77 serves as a needle bar position changing control unit operated so that the vertical position of the needle bar 12 is changed via the needle bar vertically moving mechanism 18. When the needle up-down key 77 is operated during stop of the needle bar 12, the switching operation is effected, so that the needle bar vertically moving mechanism 18 is driven according to the presence or absence of the thread cassette 10 attached to the cassette mount 5 and the position of the needle bar at the time of operation of the needle up-down key 7, whereupon the needle bar 5 is changed to a predetermined upper or lower stop position.

For the purpose of the above-described change in the needle bar position, the sewing machine M includes a spindle angle sensor 71 (see FIG. 15) for detecting an angle of the spindle 9*a* rotated by the sewing machine motor 9 and cassette detecting switch 72 (see FIG. 15) for detecting the presence or absence of the thread cassette attached to the thread cassette 5.

The spindle angle sensor 71 comprises an encoder having an encoder disc fixed to the spindle 9*a* and a photo-interrupter sandwiching the encoder disc, for example. The cassette detecting switch 72 comprises a limit switch, for example and is mounted to a portion of the head near the lower end of the cassette mount 5. The cassette detecting switch 72 is turned on when the thread cassette 10 is attached to the cassette mount 5. The cassette detecting switch 72 is turned off when the thread cassette 10 is pulled so as to be ascended from the cassette mount 5 a predetermined distance.

A thread winding mechanism (not shown) is provided in the right portion of the arm 3. The thread winding mechanism has a bobbin thread winding shaft which is switched between a standby position and a bobbin thread winding position. When the motor 9 is driven while the bobbin thread winding shaft is at the bobbin thread winding position, a driving force of the motor is transmitted to the thread winding mechanism to rotate the thread winding shaft but not to the needle bar vertically moving mechanism 18.

A bobbin mounted on the thread winding shaft is rotated with the bobbin thread winding shaft so that a thread is drawn from a supply of thread attached to a predetermined mount to be wound as a bobbin thread. For example, the thread supply may be the thread spool 13 accommodated in the thread cassette 10. A bobbin thread winding switch detecting switch 73 (see FIG. 15) is provided for detecting a position of the bobbin thread winding shaft (a standby position or bobbin thread winding position).

Figure 15:
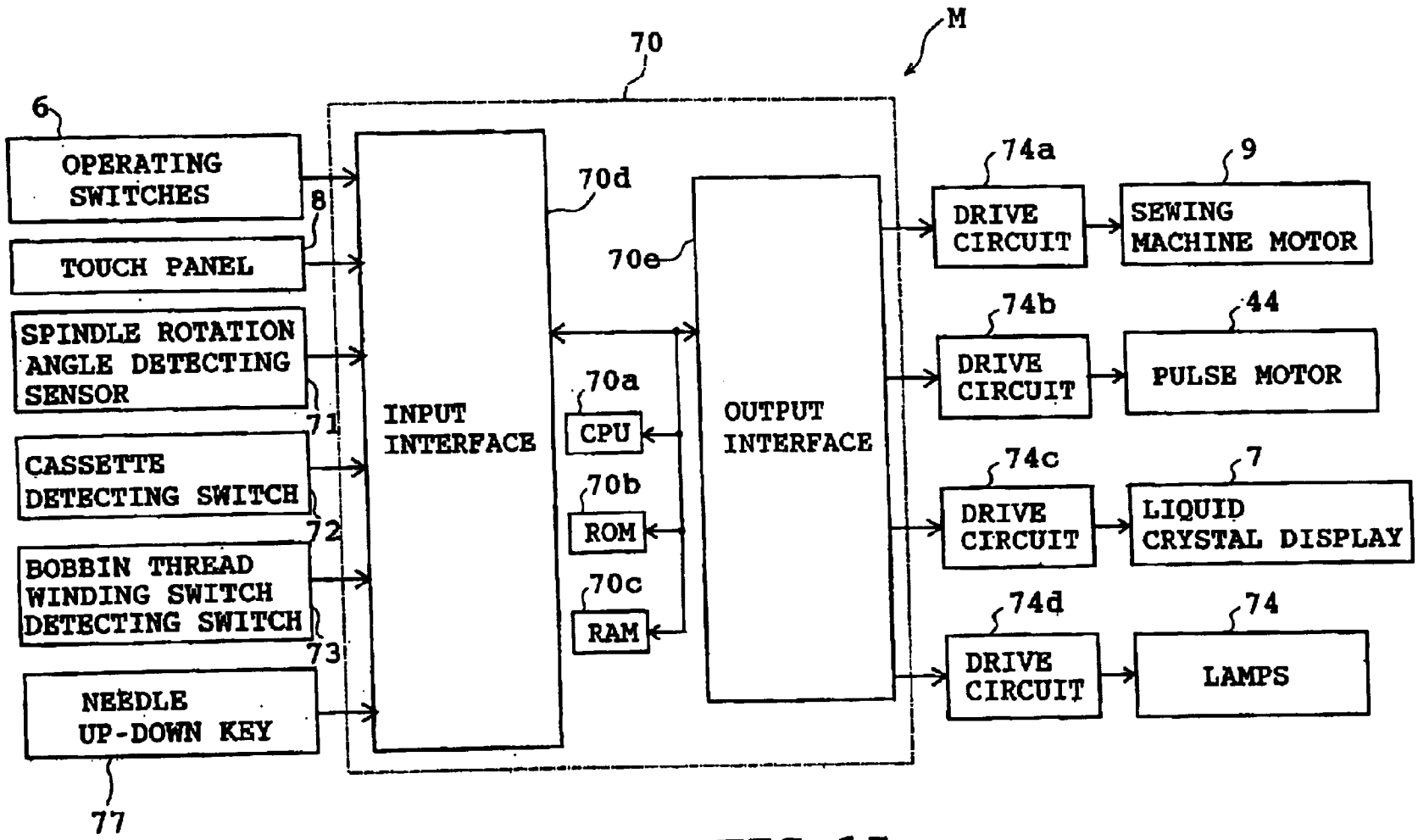
FIG. 15 is a block diagram showing an electrical arrangement of the control system of the sewing machine.

The control system of the sewing machine M will be described. Referring to FIG. 15, the sewing machine M includes a control device 70 having CPU 70*a*, ROM 70*b*, RAM 70*c*, an input interface 70*d* and an output interface 70*e*. To the input interface 70*d* are electrically connected operating switches 6, the touch-panel 8, spindle angle sensor 71, cassette detecting switch 72, the bobbin thread winding switch detecting switch 73 and needle up-down key 77. To the output interface 70*e* are electrically connected drive circuits 75*a* to 75*d* driving the sewing machine motor 9, pulse motor 44, liquid crystal display 7 and lamps 74 respectively.

Figure 16:
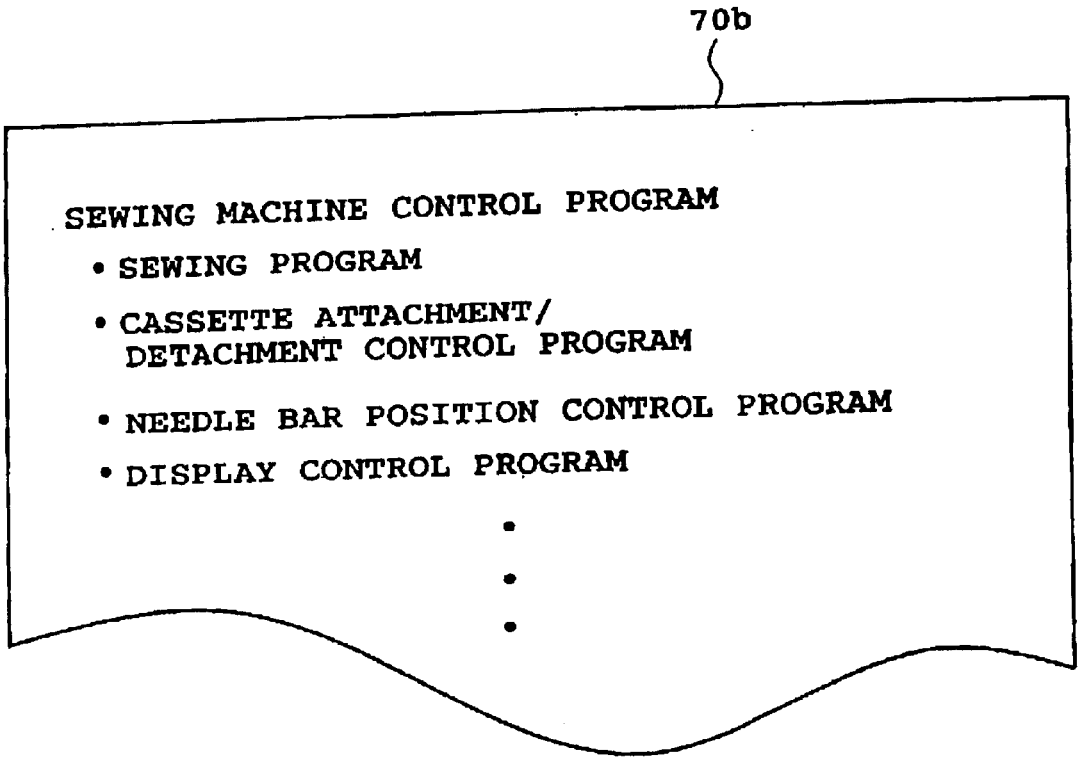
FIG. 16 is a schematic diagram of a program stored in ROM of a control device.

ROM 70*b* stores a control program for the sewing machine M as shown in FIG. 16. The control program includes a sewing control program for the sewing operation, a cassette attachment and detachment control program for attaching and detaching the thread cassette 10 to and from the cassette mount 5, and a needle bar position change control program for changing a vertical position of the needle bar.

In the needle bar position changing control, the control device 70 controls the needle bar vertically moving mechanism 18 in the following manner. In the case where the needle up-down key 77 has been operated, the needle bar 12 is changed from an upper stop position to a lower stop position or from the lower stop position to the upper stop position according to a position of the needle bar at the time of operation of the needle up-down key 77 when the thread cassette 10 is attached to the cassette mount 5 according to a result of detection by the cassette detector. Furthermore, when the thread cassette 10 is unattached to the cassette mount 5, the needle bar 12 is changed to the upper stop position irrespective of the position of the needle bar at the time of operation of the needle up-down key 77. Particularly when the thread cassette 10 is unattached to the cassette mount 5, the needle bar is changed to the lower stop position once and subsequently to the upper stop position in the case where the needle bar 12 is at the upper stop position. This control manner means that the needle bar 12 is transferred via the lower stop position to the upper stop position. In this case, the movement direction of the needle bar 12 is reversed at the lower stop position. However, this does never mean that the needle bar 12 is stopped at the lower stop position for a predetermined period of time.

Figure 17:
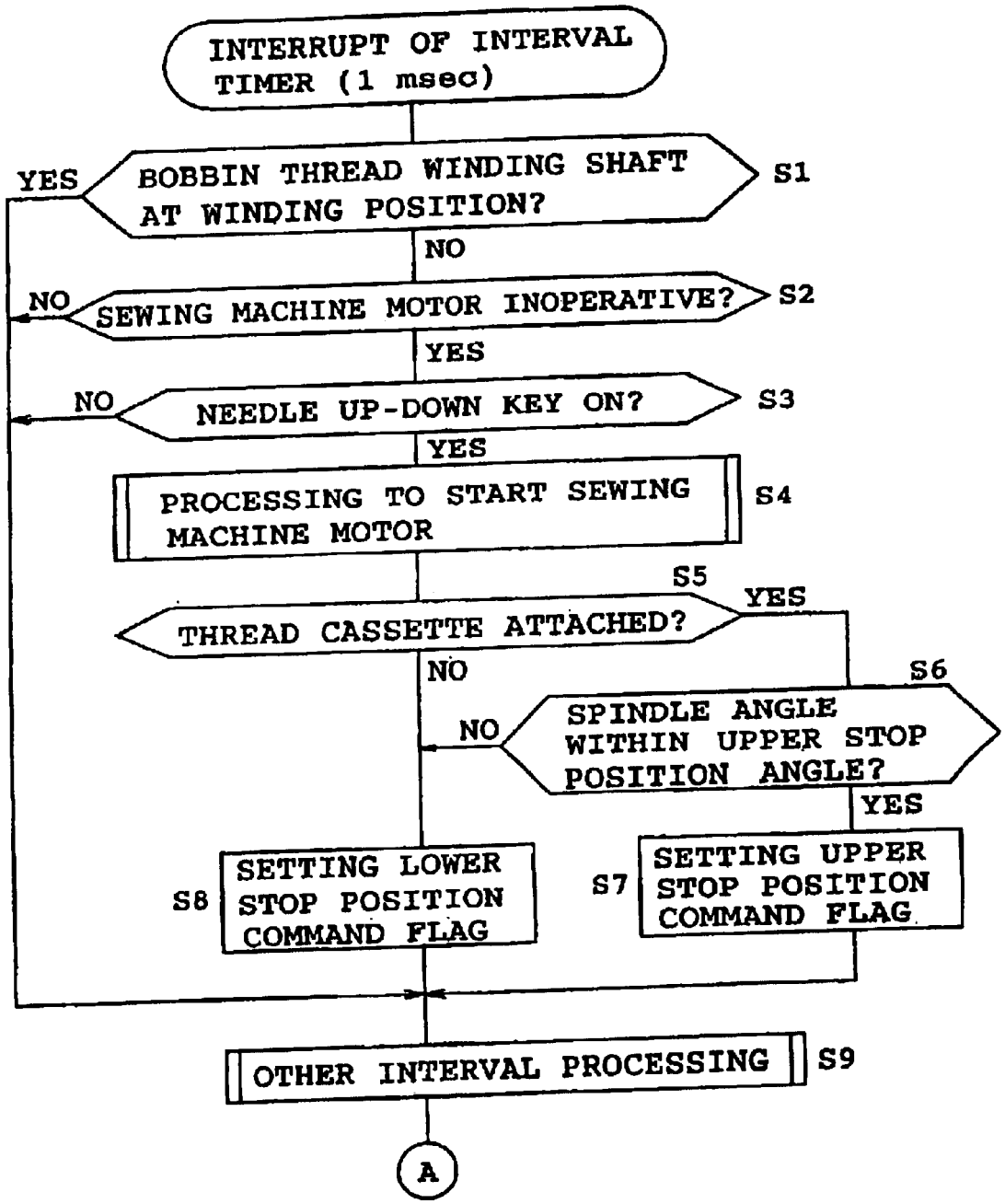
FIG. 17 is a first half of flowchart including a needle bar position changing control.

The following is the description of control carried out by the control device 70 on the basis of the needle bar position changing control program. Referring to FIG. 17, the control starts with interrupt at intervals of 1 msec. When the bobbin thread winding shaft is not at the bobbin thread winding position (NO at step S1; sewable condition), the control device 70 advances to step S2. When the motor 9 is inoperative (YES at step S2), the control device 70 advances to step S3. When the needle up-down key 77 is operated to be turned on (YES at step S3), the control device 70 advances to step S4. Furthermore, the control device 70 advances to step S9 when the bobbin thread winding shaft is at the bobbin thread winding position (YES at step S1), when the motor 9 is not inoperative (NO at step S2), or when the needle up-down key 77 is not operated (NO at step S3).

When a sewing machine motor start processing is carried out at step S4, the needle bar vertically moving mechanism 18 is driven by the motor 9 so that the needle bar 12 is vertically moved. At this time, the control device 70 determines the presence or absence of the thread cassette 10 attached to the cassette mount 5, based on the result of detection by the cassette detecting switch 72 (step S5). When the thread cassette 10 has been attached to the cassette mount 5 (YES at step S5) and the spindle angle is an upper stop position angle (YES at step S6), the control device 70 sets a lower stop position command flag (step S7) and subsequently advances to step S9.

The spindle angle is calculated on the basis of information from the spindle angle sensor 71 comprising the encoder. In this case, the angle of the spindle at the needle upper position, which is an upper limit position of the needle bar 12 (or needle 12*a*) is 0 degrees or 360 degrees. The aforesaid upper stop position angle is previously set to a range from 20 to 50 degrees. Furthermore, when the thread cassette 10 is unattached to the cassette mount 5 (No at step S5) or when the thread cassette has been attached to the cassette mount 5 but the spindle angle is not at the upper stop position angle (YES at step S5; NO at step S6), the control device 70 sets the upper stop position command flag (step S8) and subsequently advances to step S9. The aforesaid lower stop position angle is previously set to a range from 200 to 230 degrees, for example.

Figure 18:
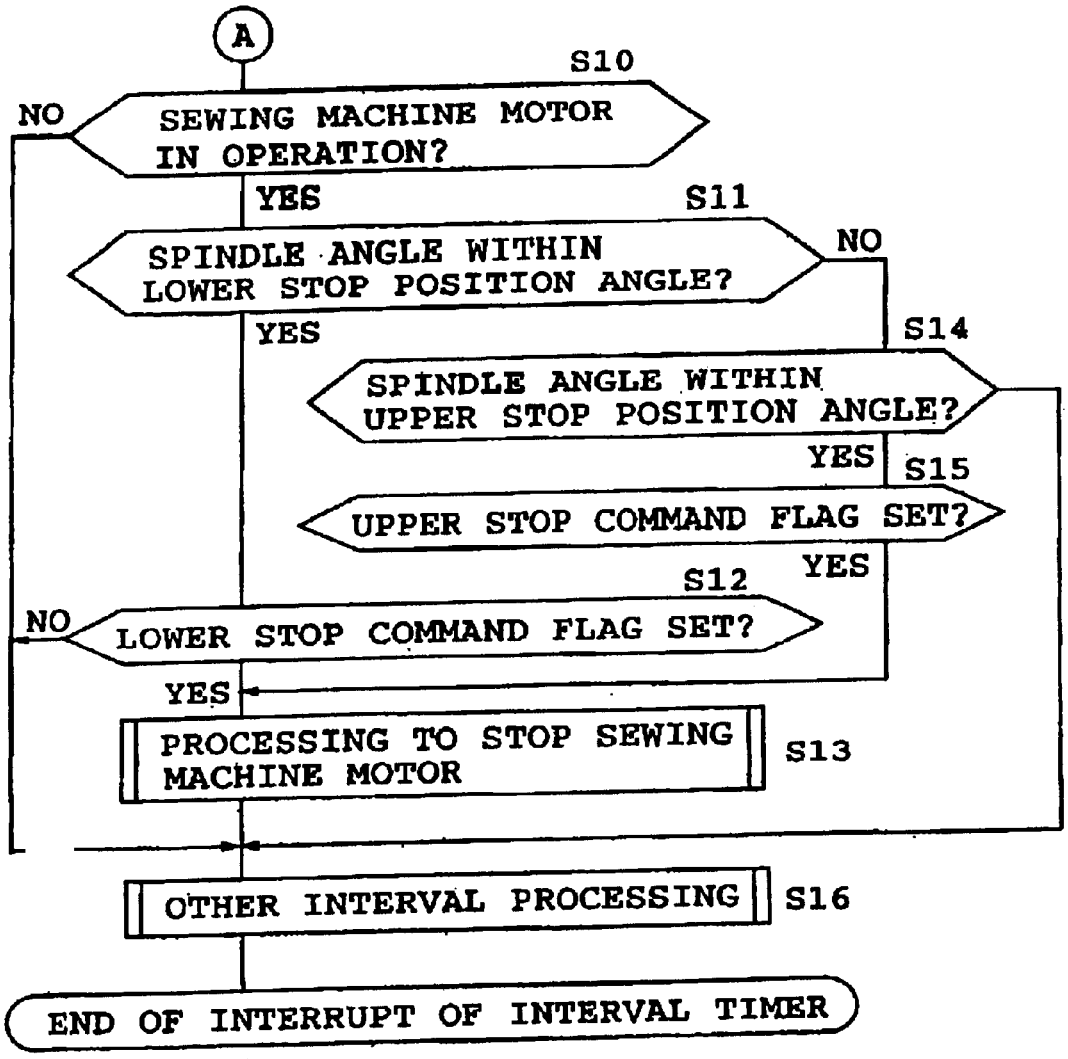
FIG. 18 is a second half of the flowchart including the needle bar position changing control.

After execution of the other interval processing (step S9), the control device 70 advances to the control as shown in FIG. 18. When the motor 9 is in operation (YES at step S10), the control device 70 determines whether the spindle angle is at the lower stop position angle (step S11). In the case where the spindle angle is at the lower stop position angle (YES at step S11), the control device 70 carries out a sewing machine motor stop processing (step S13) when the lower stop position flag has been set (YES at step S12). As a result, the motor 9 is stopped so that the needle bar 12 is stopped at the lower stop position.

On the other hand, when the spindle angle is not at the lower stop position angle (NO at step S11) or when the spindle angle is at the upper stop position angle (YES at step S14) but the upper stop command flag has been set (YES at step S15), the control device 70 carries out the sewing machine motor stop processing (step S13), whereupon the motor 9 is stopped so that the needle bar 12 is stopped at the upper stop position. The control device 70 carries out the other interval processing (step S16) after step S13 or after the negative determination has been made at step S10, S12, S14 or S15, thereafter finishing the control.

By the above-described control, the position of the needle bar 12 is changed as shown in FIG. 19 on the basis of the presence or absence of the thread cassette 10 attached to the thread cassette 5 and the needle bar position when the needle up-down key 77 is operated. The control device 70 and the control manners as shown in FIGS. 17 and 18 serve as a needle bar position changing control unit in the invention. Steps S3 to S8 and S10 to S15 correspond to a first routine in the invention, whereas steps S3 to S5, S8, S10, S11, S14 and S15 correspond to a second routine in the invention.

The operation of the sewing machine M will now be described. In order that the thread cassette 10 maybe attached to the cassette mount 5, the thread cassette 10 is threaded so that the thread 11 drawn from the thread spool 22 extends around the cassette, whereby the thread cassette 10 is prepared. After the preparation, the thread cassette 10 is attached to the cassette mount 5. The threading and thread carrying mechanisms 16B and 16A are then operated synchronously. When the needle bar 12 is stopped at least at the upper stop position, the thread 11 drawn from the thread cassette 10 is passed through the eye 12*b* of the needle 12*a* attached to the needle bar 12, by the threading and thread carrying mechanisms 16B and 16A. The cassette detecting switch 72 is turned on when the thread cassette 10 has been inserted to each the lowermost position of the cassette mount 5.

However, the needle bar 12 is not always stopped at the upper stop position when the thread cassette 10 is attached to the cassette mount 5. Passing the thread 11 through the needle eye 12*b* may fail when the thread cassette 10 is attached to the cassette mount 5 and the threading mechanism 16B is operated while the needle bar 12 is stopped at a position other than the upper stop position. In this case, the thread cassette 10 needs to be re-attached to the cassette mount 5 and the thread cassette needs to be re-threaded. Thus, load applied to the user is increased, resulting in inconvenience.

In view of the above-described problem, the needle up-down key 77 is operated once before the thread cassette 10 is attached to the cassette mount 5. In this case, since the thread cassette 10 is not attached to the cassette mount 5, the needle bar 12 is reliably changed to the upper stop position no matter where the needle bar may be located. Accordingly, when the thread cassette 10 is thereafter attached to the cassette mount, the thread 11 drawn from the thread cassette 10 can be passed through the needle eye 12*b* reliably. Consequently, failure in threading can be prevented and accordingly, the threading mechanism 168 etc. can be prevented from being broken. In the case where the thread cassette 10 has already been attached to the cassette mount 5, the needle bar 12 can be switched between the upper and lower stop positions alternately according to the position of the needle bar at the time of operation every time the needle up-down key 77 is operated once. Consequently, the convenience of the sewing machine M can be improved.

In the foregoing embodiment, the convenience of the sewing machine can be improved since the needle bar 12 is changed to a suitable position according to the presence or absence of the thread cassette 10 attached to the cassette mount 5. Particularly in the case where the thread cassette 10 is not attached to the cassette mount 5, the needle bar 12 can be changed to the upper stop position readily and reliably when the needle up-down key 77 is operated once. Thus, the preparation for attachment of the thread cassette 10 can easily be made. Furthermore, the needle bar 12 is changed to the lower stop position once and then to the upper stop position when the thread cassette 10 is not attached to the cassette mount 5 and the position of the needle bar at the time of operation of the needle up-down key 77 is the upper stop position. Accordingly, the user can clearly find that the needle bar 12 has been changed to the upper stop position. Additionally, in the case where the needle up-down key 77 is operated when the thread cassette 10 has been attached to the cassette mount 5, the control device 70 controls the motor 9 so that the stop position of the needle bar 12 is changed every time the needle up-down key is operated. Thus, the sewing machine M can be used in the conventional manner.

A modified form of the above-described embodiment will be described. In the foregoing embodiment, in the case where the thread cassette 10 is not attached to the cassette mount 5 and the needle bar is located at the upper stop position, the spindle 9*a* is driven by the motor 9 when the needle up-down key 77 is operated. As a result, the needle bar 12 is changed to the lower stop position once and then to the upper stop position. However, the spindle 9*a* may not be driven even when the needle up-down key 77 is operated. In other words, the needle bar 12 may be maintained at the upper stop position without being moved to the lower stop position.

Figure 20:
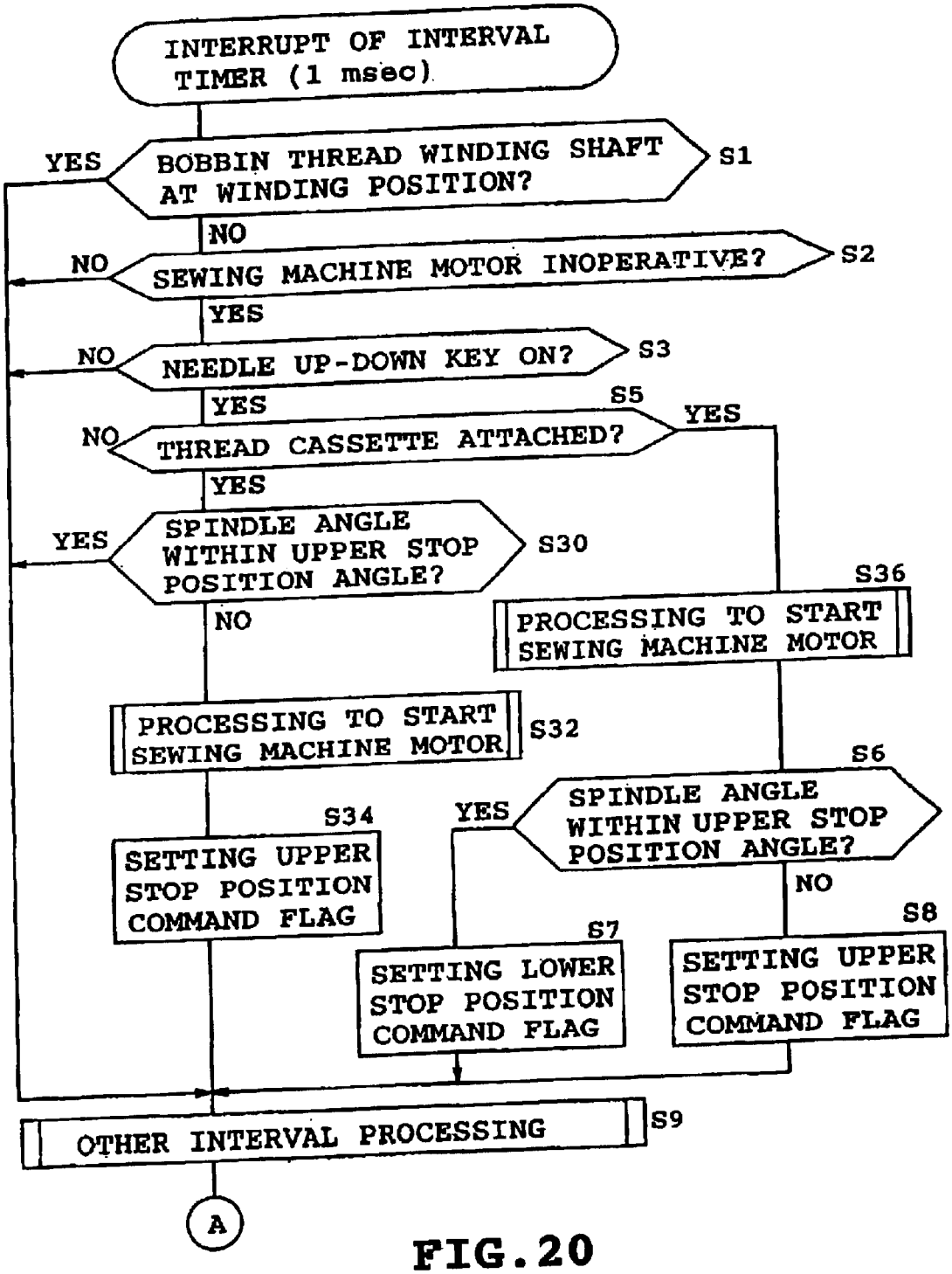
FIG. 20 is a flowchart including the needle bar position changing control in a modified form of the sewing machine.

In the modified form, as shown in FIG. 20, when the needle up-down key 77 has been operated (YES at step S3), the control device 77 determines whether the thread cassette 10 has been attached to the cassette mount 5 (step S5). When the thread cassette 10 has been unattached to the cassette mount 5 (NO at step S5) and the spindle angle is the upper stop position angle (YES at step S30), the other interval processing (step S9) is carried out without drive of the motor 9 since the needle eye 12*b* has already been located at a location where threading is possible. Furthermore, when the spindle angle is not the upper stop position angle (NO at step S30), the sewing machine motor start processing (step S32) and setting the upper stop command flag (step S34) are carried out. When the thread cassette 10 has been attached to the cassette mount 5 (YES at step S30), the sewing machine motor start processing (step S36) and steps (Steps S6 to S8) for setting a stop command flag are carried out.

In the previous embodiment, in the case where the thread cassette 10 has been attached to the cassette mount 5 and the needle up-down key is operated, the needle bar 12 is changed to the upper stop position when the position of the needle bar at the time of operation is other than the lower stop position. However, when the needle bar 12 is at a position between the lower stop position and the upper stop position, said position excluding the lower and upper stop positions, the needle bar may be changed to the upper stop position. The needle bar 12 may be changed to the lower stop position when the needle bar 12 is at a position between the upper stop position and the lower stop position, said position excluding the lower and upper stop positions.

Figure 21:
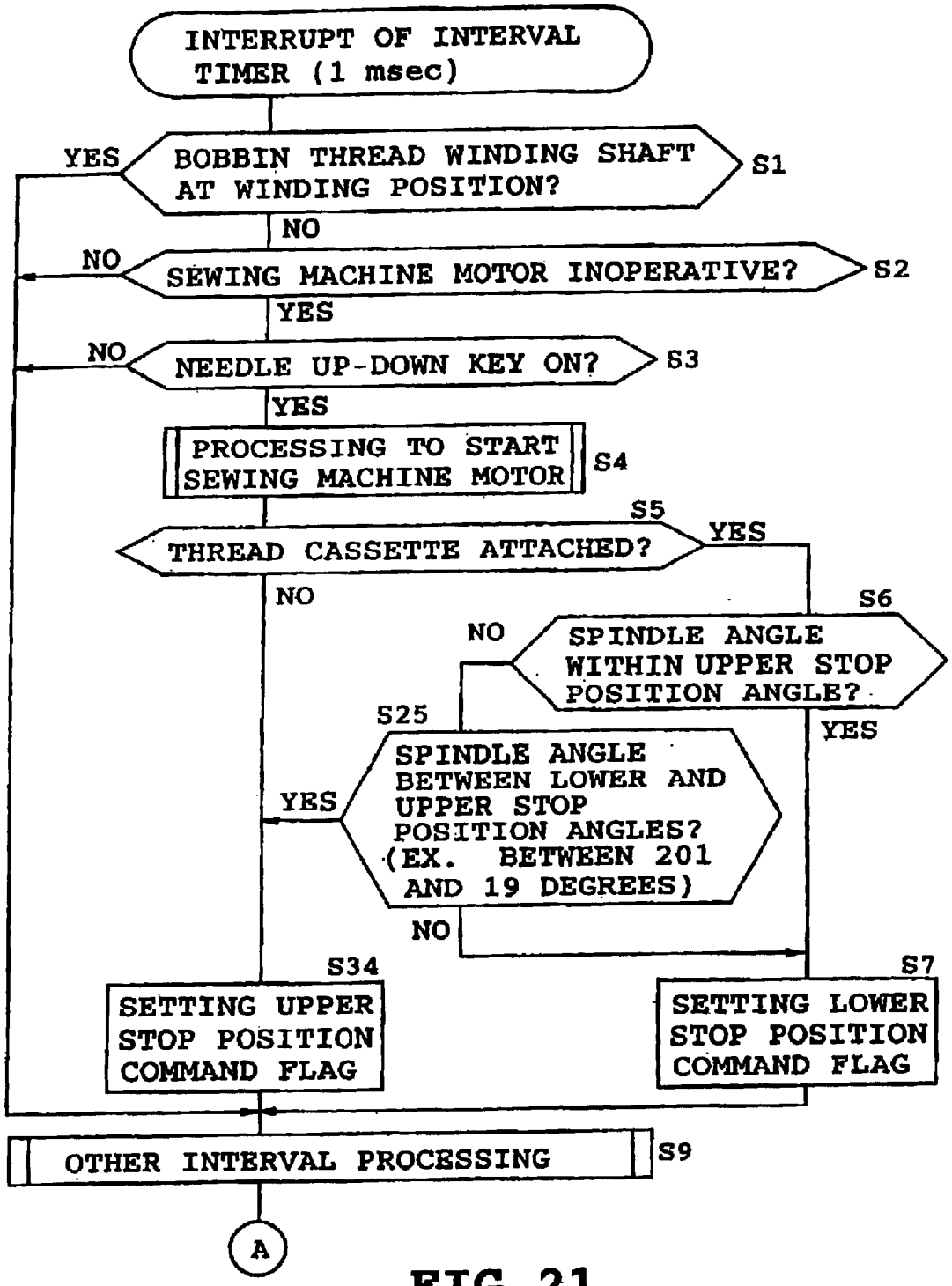
FIG. 21 is a flowchart including the needle bar position changing control in another modified form of the sewing machine.

In the above-described case, as shown in FIG. 21, a step S25 may be added after the negative determination at step S6. At step S25, the control device determines whether the spindle angle is between the lower and upper stop position angles (for example, 201 and 19 degrees). When the spindle angle is between the lower and upper stop position angles (YES at step S25), the upper stop command flag is set (step S8). When the spindle angle is not between the lower and upper stop position angles (NO at step S25), the lower stop command flag is set (step S7) and in the subsequent stop control, the needle bar is changed to the above-described position.

Furthermore, an informing section such as LED etc. may be provided near the cassette mount 5 of the head 4. When the needle bar 12 is stopped at the upper stop position and the thread cassette 10 can be attached to the cassette mount 5, the informing section may be turned on to inform that the thread cassette 10 can be attached to the cassette mount 5. Furthermore, when the needle bar 12 is not stopped at the upper stop position, the informing section may be turned off to inform that the thread cassette 10 cannot be attached to the cassette mount 5.

The thread cassette 10 in the foregoing embodiment is a mere example and need not be a supply of thread in which the thread is wound on a thread spool. For example, a mere mass of thread may be accommodated in the accommodating cavity. Furthermore, at least one of the walls covering the thread accommodating cavity may be eliminated and the thread spool may be held on a holding portion such as a spool pin.

The needle bar position changing control program stored in ROM 70*b* of the control device 70 may be applied to sewing machines similar to the sewing machine M. The needle bar position changing control program may be supplied via communication means such as the Internet or may be recorded on a recording medium such as CD, MD or FD to be supplied on the recording medium. The first and second routines are the same as described above.

In the foregoing embodiment, the needle bar 12 is not stopped at the lower stop position where the direction of movement of the needle bar is reversed when the thread cassette 10 has not been attached to the cassette mount and the needle bar is at the upper stop position at the time of operation thereof. However, the needle bar may be stopped at the lower stop position and automatically moved to the upper stop position after a predetermined period of time.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A sewing apparatus comprising:

a needle bar;

a needle bar vertically moving mechanism vertically moving the needle bar;

a needle bar position changing operation unit operated via the needle bar vertically moving mechanism to change a vertical position of the needle bar;

a thread cassette having a thread accommodating section accommodating a supply of thread;

a cassette mount to which the thread cassette is detachably attached;

a cassette detector detecting the thread cassette attached to the cassette mount; and a needle bar position changing control unit controlling the needle bar vertically moving mechanism so that in a case where the needle bar position changing unit has been operated, the needle bar is changed from an upper stop position to a lower stop position or from the lower stop position to the upper stop position according to a position of the needle bar at the time of operation of the needle bar position changing unit when the thread cassette is attached to the cassette mount according to a result of detection by the cassette detector, the needle bar position changing control unit further controlling the needle bar vertically moving mechanism so that the needle bar is changed to the upper stop position irrespective of the position of the needle bar at the time of operation of the needle bar position changing unit when the thread cassette is unattached to the cassette mount according to the result of detection by the cassette detector.

2. A sewing apparatus according to claim 1, wherein the needle bar position changing control unit controls the needle bar vertically moving mechanism so that when the thread cassette is unattached to the cassette mount according to the result of detection by the cassette detector and the needle bar is at the upper stop position, the needle bar is changed to the lower stop position once and subsequently to the upper stop position.

3. A sewing apparatus according to claim 1, further comprising a threading mechanism passing the thread drawn from the thread cassette through an eye of a needle attached to the needle bar when the thread cassette is attached to the cassette mount, wherein the upper stop position is determined so that the threading mechanism is operable to pass the thread drawn from the thread cassette through the needle eye.

4. A needle bar position changing control program for a sewing apparatus including a needle bar, a needle bar vertically moving mechanism vertically moving the needle bar, a needle bar position changing operation unit operated via the needle bar vertically moving mechanism to change a vertical position of the needle bar, a thread cassette having a thread accommodating section accommodating a supply of thread, a cassette mount to which the thread cassette is detachably attached, and a cassette detector detecting the thread cassette attached to the cassette mount, the program executing on a computer a control for changing a position of the needle bar and comprising the routines of:

controlling the needle bar vertically moving mechanism so that in a case where the needle bar position changing unit has been operated, the needle bar is changed from an upper stop position to a lower stop position or from the lower stop position to the upper stop position according to a position of the needle bar at the time of operation of the needle bar position changing unit when the thread cassette is attached to the cassette mount according to a result of detection by the cassette detector; and controlling the needle bar vertically moving mechanism so that the needle bar is changed to the upper stop position irrespective of the position of the needle bar at the time of operation of the needle bar position changing unit when the thread cassette is unattached to the cassette mount according to the result of detection by the cassette detector.

5. A sewing apparatus comprising:

a needle bar;

a needle bar vertically moving mechanism vertically moving the needle bar;

a needle bar position changing operation unit operated via the needle bar vertically moving mechanism to change a vertical position of the needle bar;

a thread cassette having a thread accommodating section accommodating a supply of thread;

a cassette mount to which the thread cassette is detachably attached;

a cassette detector detecting the thread cassette attached to the cassette mount; and a needle bar position changing control unit controlling the needle bar vertically moving mechanism so that in a case where the needle bar position changing unit has been operated, the needle bar is changed to an upper stop position irrespective of a position of the needle bar at the time of operation of the needle bar position changing unit when the thread cassette is unattached to the cassette mount according to the result of detection by the cassette detector.

6. A sewing apparatus according to claim 5, wherein the needle bar position changing control unit controls the needle bar vertically moving mechanism so that when the thread cassette is unattached to the cassette mount according to the result of detection by the cassette detector and the needle bar is at the upper stop position, the needle bar is changed to the lower stop position once and subsequently to the upper stop position.

7. A sewing apparatus according to claim 5, further comprising a threading mechanism passing the thread drawn from the thread cassette through an eye of a needle attached to the needle bar when the thread cassette is attached to the cassette mount, wherein the upper stop position is determined so that the threading mechanism is operable to pass the thread drawn from the thread cassette through the needle eye.

* * * * *